US008075207B2

(12) United States Patent
Huggins et al.

(10) Patent No.: US 8,075,207 B2
(45) Date of Patent: Dec. 13, 2011

(54) PORTABLE PRINTER

(75) Inventors: Orville C. Huggins, Centerville, OH (US); Thomas P. Keller, Centerville, OH (US); David S. Prows, Cincinnati, OH (US); David R. Wisecup, Xenia, OH (US)

(73) Assignee: Avery Dennison Corporation, Pasadena, CA (US)

( * ) Notice: Subject to any disclaimer, the term of this patent is extended or adjusted under 35 U.S.C. 154(b) by 186 days.

(21) Appl. No.: 12/512,100

(22) Filed: Jul. 30, 2009

(65) Prior Publication Data

US 2009/0290925 A1 Nov. 26, 2009

Related U.S. Application Data

(60) Continuation of application No. 12/062,713, filed on Apr. 4, 2008, now abandoned, and a continuation-in-part of application No. 11/252,314, filed on Oct. 17, 2005, now Pat. No. 7,387,456, and a continuation-in-part of application No. 11/026,719, filed on Dec. 30, 2004, now Pat. No. 7,029,189, and a continuation-in-part of application No. 10/660,838, filed on Sep. 12, 2003, now Pat. No. 6,837,634, and a continuation-in-part of application No. 10/078,557, filed on Feb. 15, 2002, now Pat. No. 6,623,191, and a division of application No. 09/800,339, filed on Mar. 6, 2001, now Pat. No. 6,347,897, and a division of application No. 09/397,221, filed on Sep. 16, 1999, now Pat. No. 6,241,407.

(51) Int. Cl.

| | |
|---|---|
| ***B41J 3/36*** | (2006.01) |
| ***B41J 15/00*** | (2006.01) |
| ***B41J 29/02*** | (2006.01) |

(52) U.S. Cl. ..... 400/88; 400/621; 400/693; 400/613

(58) Field of Classification Search ..... 400/88, 400/613, 621, 691–693; 156/250, 384
See application file for complete search history.

(56) References Cited

U.S. PATENT DOCUMENTS 355,264 A 12/1886 Haven
(Continued)

FOREIGN PATENT DOCUMENTS

EP 0191495 8/1986
(Continued)

OTHER PUBLICATIONS

Axiohm Thermal Printer Mechanism, User's Manual THTP Series, Preliminary Issue, Reference 3104660-FDE, Oct. 1998.

*Primary Examiner* — Leslie J Evanisko
*Assistant Examiner* — Marissa Ferguson Samreth

(57) ABSTRACT

There is disclosed a lightweight portable printer having a frame or housing with a print head and a cooperable platen roll mounted in the housing. The housing pivotally mounts a subassembly. The subassembly mounts an electric motor and gearing driven by the motor for driving the platen roll. The subassembly is resiliently urged to press the print head against the platen roll. The printer has a front door which provides access to the inside of the housing. The front door mounts the platen roll, a label delaminator, a pressure roll, a holder for mounting a supply roll of labels or tags, and a latch for latching the door to the housing and for camming the pressure roll into and out of cooperation with the platen roll.

14 Claims, 22 Drawing Sheets

U.S. PATENT DOCUMENTS 4,011,813 A 3/1975 Sams
3,890,188 A 6/1975 Sams
4,330,219 A 5/1982 Miyasaka et al.
4,579,466 A 4/1986 Sato et al.
4,649,264 A 3/1987 Carson
4,727,245 A 2/1988 Dobbins et al.
4,759,646 A 7/1988 Platt
4,776,714 A 10/1988 Sugiura et al.
4,826,558 A 5/1989 Wada et al.
4,851,812 A 7/1989 Holmberg
4,956,045 A 9/1990 Goodwin et al.
5,049,228 A * 9/1991 Sato ..... 156/384
5,092,688 A 3/1992 Haennelt et al.
5,110,226 A 5/1992 Sherman et al.
5,122,005 A 6/1992 Kamei
5,150,130 A 9/1992 Sato
5,160,943 A 11/1992 Pettigrew et al.
5,163,766 A 11/1992 Fushimi et al.
5,172,137 A 12/1992 Hongo et al.
5,187,798 A 2/1993 Nambudiri et al.
5,206,660 A 4/1993 Cochrane et al.
5,267,800 A 12/1993 Petteruti et al.
5,276,527 A 1/1994 Sugiyama et al.
5,411,342 A 5/1995 Horie et al.
5,427,460 A 6/1995 Kajiya
5,447,379 A 9/1995 Pou
5,447,380 A 9/1995 Colonel et al.
5,486,259 A 1/1996 Goodwin et al.
5,518,324 A 5/1996 Campbell et al.
5,560,293 A 10/1996 Boreali et al.
5,570,121 A 10/1996 Mistyurik et al.
5,588,756 A 12/1996 Hamisch, Jr. et al.
5,609,429 A 3/1997 Fogle et al.
5,708,462 A 1/1998 Helmbold et al.
5,718,526 A 2/1998 Yokota
5,785,442 A 7/1998 Hamisch, Jr. et al.
5,788,384 A 8/1998 Goodwin et al.
5,791,796 A 8/1998 Gustavsson et al.
5,800,669 A 9/1998 Goodwin et al.
5,806,993 A 9/1998 Petterutti et al.
5,816,718 A 10/1998 Poole
5,833,377 A 11/1998 Keller et al.
5,860,753 A 1/1999 Beck et al.
5,988,249 A 11/1999 Mistyurik et al.
6,004,053 A 12/1999 Petteruti et al.
6,010,257 A 1/2000 Petteruti et al.
6,030,133 A 2/2000 Endo
6,065,679 A 5/2000 Levie et al.
6,068,419 A 5/2000 Shiozaki et al.
6,092,945 A 7/2000 Takami et al.
6,129,276 A 10/2000 Jelen et al.
6,241,407 B1 6/2001 Huggins et al.
6,250,827 B1 6/2001 Nojima et al.
6,261,013 B1 7/2001 Bryer et al.
6,315,470 B1 11/2001 Vaghi
6,364,550 B1 4/2002 Petteruti
6,382,851 B2 5/2002 Fujiwara
6,406,200 B2 6/2002 Mahoney
6,503,005 B1 1/2003 Cockerill et al.
6,530,705 B1 3/2003 Petteruti et al.
7,083,344 B2 * 8/2006 Miyasaka et al. ..... 400/613

FOREIGN PATENT DOCUMENTS

EP 0361693 4/1990
EP 0448519 9/1991
EP 0764585 3/1997
GB 2067164 7/1981
GB 2226794 7/1990
JP 04-272876 9/1992

* cited by examiner

PORTABLE PRINTER

CROSS-REFERENCE TO RELATED APPLICATIONS

This application is a continuation of pending application Ser. No. 12/062,713 filed Apr. 4, 2008 which is a continuation of Ser. No. 11/252,314 filed Oct. 17, 2005, now U.S. Pat. No. 7,387,456, which is a continuation of Ser. No. 11/026,719 filed Dec. 30, 2004, now U.S. Pat. No. 7,029,189, which is a continuation of Ser. No. 10/660,838 filed Sep. 12, 2003, now U.S. Pat. No. 6,837,634, which is a continuation of Ser. No. 10/078,557 filed Feb. 15, 2002, now U.S. Pat. No. 6,623,191, which is a division of Ser. No. 09/800,339 filed Mar. 6, 2001, now U.S. Pat. No. 6,347,897, which is a division of Ser. No. 09/397,221, filed Sep. 16, 1999, now U.S. Pat. No. 6,241,407.

Ser. No. 09/801,578 filed Mar. 9, 2001, now U.S. Pat. No. 6,394,674, is another division of Ser. No. 09/397,221, now U.S. Pat. No. 6,241,407.

BACKGROUND OF THE INVENTION

1. Field of the Invention

This invention relates to the printing art.

2. Brief Description of the Prior Art

The following prior art is made of record: U.S. Pat. Nos. 4,776,714; 4,956,045; 5,447,379; 5,486,259; 5,570,121; 5,588,756; 5,806,993 and 5,833,377; and Axiohm Thermal Printer Mechanism, User's Manual THTP Series, Preliminary Issue, reference 3104660-FDE, October 1998.

SUMMARY OF THE INVENTION

This invention relates to an improved, compact, user-friendly, lightweight, small footprint, portable printer.

It is a feature of the invention to provide an improved printer wherein it is easy to load label supplies into the printer, wherein the print head is easy to clean, wherein the battery for powering the printer is easy to insert or remove, and other parts of the printer are readily accessible to the user.

In accordance with a specific embodiment of the invention, the printer has a housing containing a subassembly for mounting a print head, an electric motor and gearing driven by the motor. The housing includes another subassembly including a door for mounting a platen roll with a gear, a holder for holding a supply roll comprised either of labels releasably adhered to a carrier web, an adhesive-backed linerless web or a web of tags, a delaminator for delaminating labels from the carrier web, a pressure roller for urging the carrier web against the platen roll, a latch for latching the door to the housing, and a cam controlled by the latch for moving the pressure roll into and out of pressure contact with the platen roll. There is space within the housing for receiving a label roll. The subassembly with the motor is disposed above the label roll receiving space and is pivotal as a unit on the housing to urge the print head into cooperation with the platen roll and to bring the gearing into mesh with the gear on the platen roll. Space for receiving a battery is disposed below the label roll receiving space, and the label roll receiving space is disposed between the front door and an upstanding printed circuit board. The battery is received in a compartment having three sides. U-shaped conductors are received about the three sides of the battery compartment and make contact with the terminals of the battery and releasably detent the battery in the compartment.

Various other features and advantages will occur to those skilled in the art when referencing the following description and the accompanying drawings.

BRIEF DESCRIPTION OF THE DIAGRAMMATIC DRAWINGS

DETAILED DESCRIPTION OF THE PREFERRED EMBODIMENTS

Figure 1:
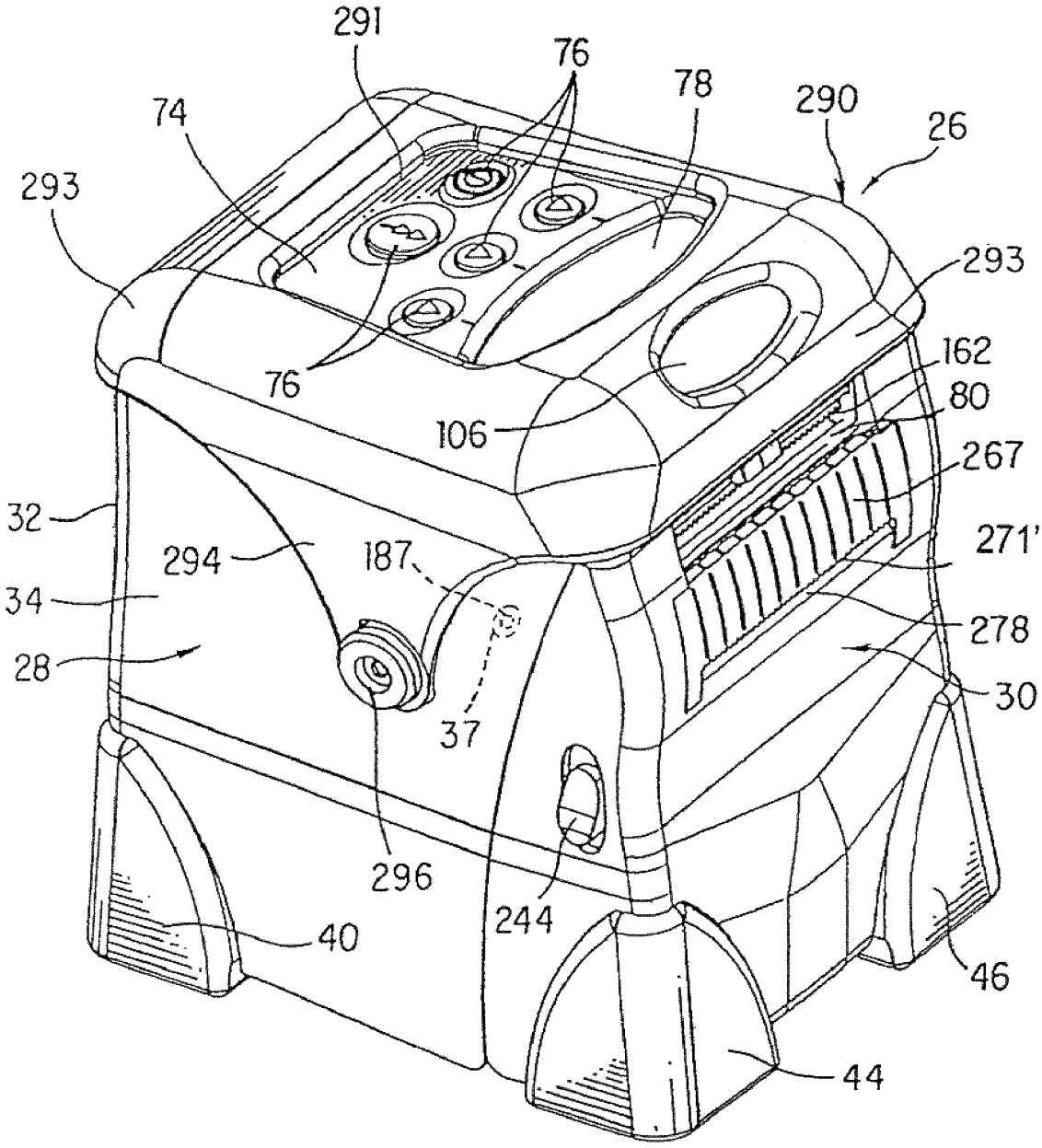
FIG. 1 is a perspective view of a printer in accordance with the invention.
Figure 10:
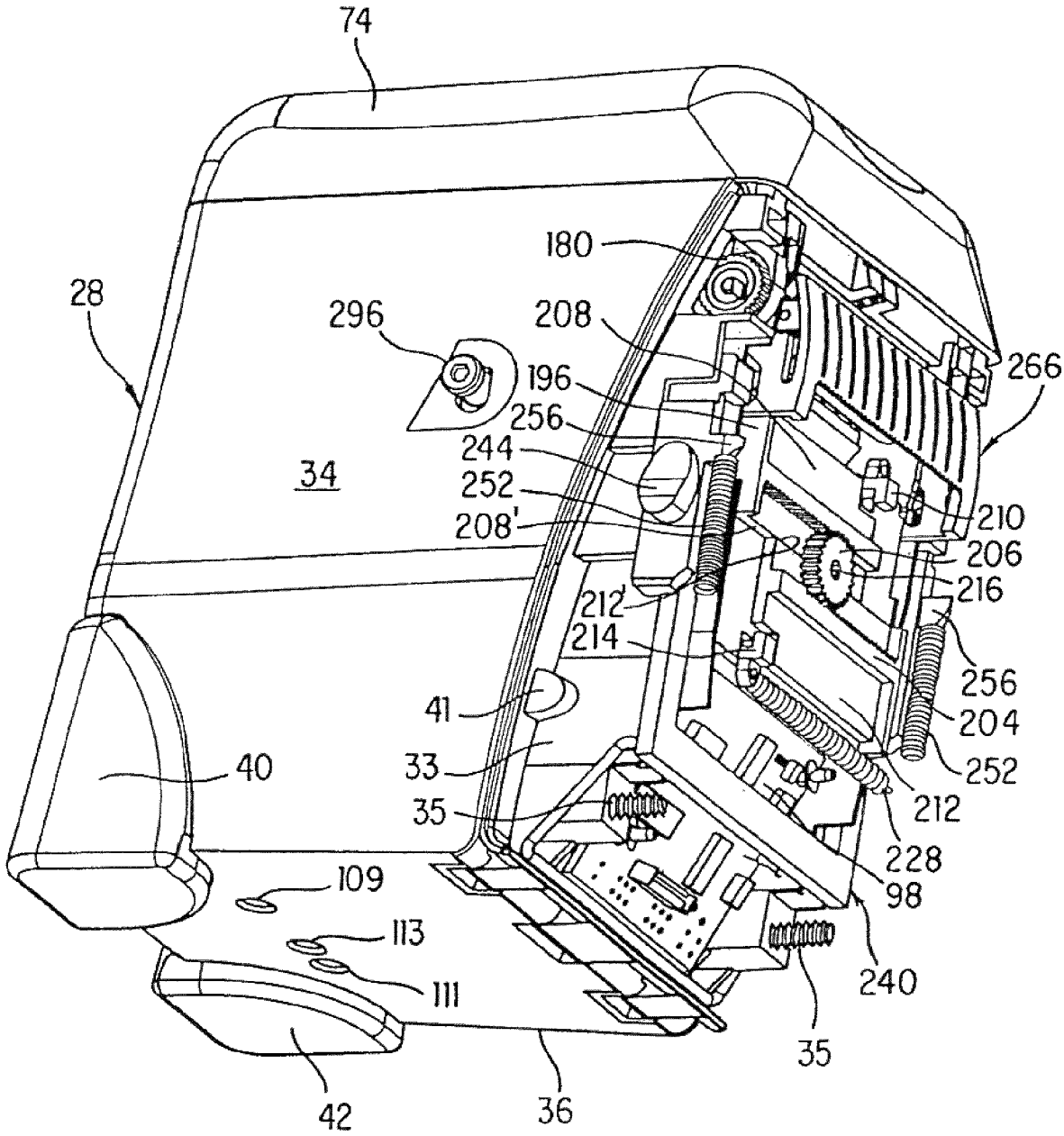
FIG. 10 is a perspective view showing the front and the right side of the printer with the outer door panel removed.
Figure 11:
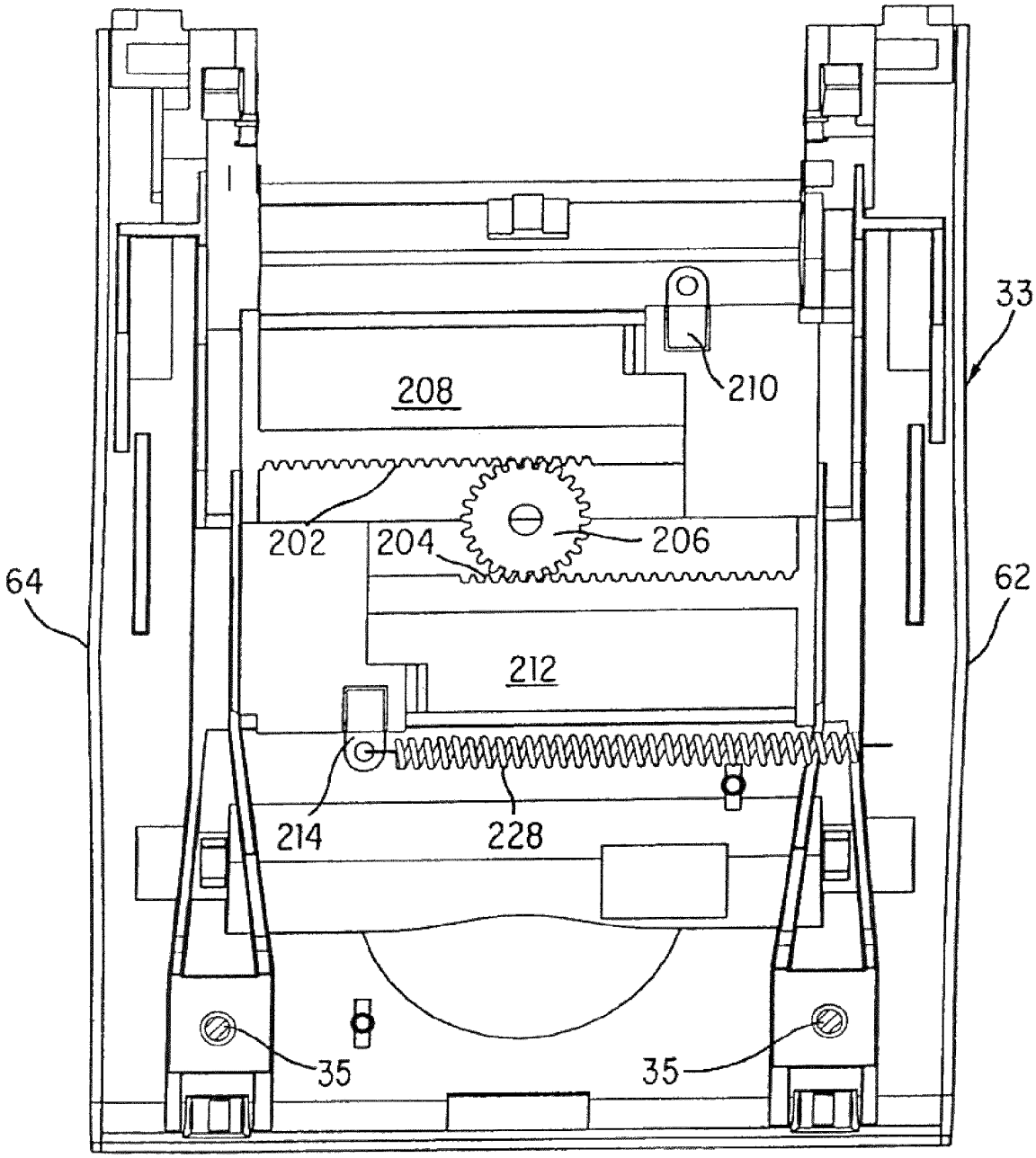
FIG. 11 is a front elevational view of the inner door panel with the outer door panel removed.
Figure 16:
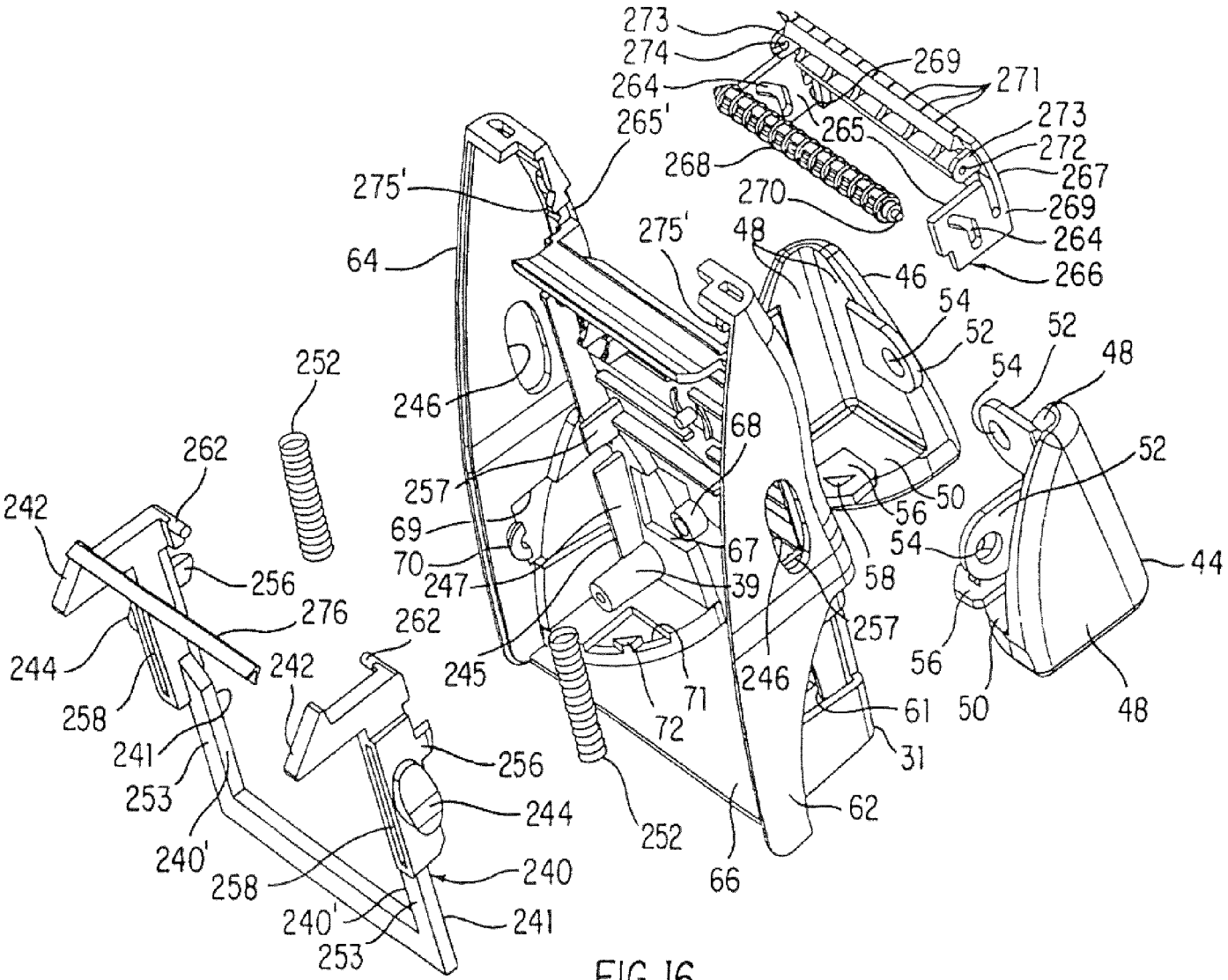
FIG. 16 is an exploded perspective view of the outer door panel, the latch, the pressure roll and carrier and two of the pads.

With reference to FIG. 1, there is shown a printer generally indicated at 26 having a housing generally indicated at 28 and a subassembly in the form of a front door 30. The housing 28 has a rear wall 32, a right side wall 34, a left side wall 36 (FIG. 10) and a bottom panel 38. The walls 32, 34 and 36 and the bottom panel 38 are integrally molded and form the frame of the printer 26. The printer 26 has four spaced, identical, one-piece, resilient, elastomeric pads 40, 42, 44 and 46 which serve as feet to support the printer 26 on a flat surface but they also serve to help protect the printer 26 from damage in the event the printer 26 is dropped. The pads 40 and 42 are secured to the lower corners of the rear portion of the housing 28 and the pads 44 and 46 are secured to an outer panel 31 of the door 30. The outer door panel 31 and an inner door panel 33 are secured to each other by screws 35 passing through holes 37 and threadably received in bosses 39. Each pad 40, 42, 44 and 46 has a pair of joined triangular-shaped side panels 48 (FIG. 16) extending at right angles to each other and joined to a bottom panel 50. The side panels 48 have tabs 52 which extend at right angles to each other. The tabs 52 have round holes 54. The bottom panel 50 has a tab 56 with a triangular-shaped hole 58. The front door panel 31 right and left side sections 62 and 64 and a bottom section 66. The tabs 52 of the pad 44 for example extend through openings 61 and 63 and the associated tab 56 extends through an opening 65. Tabs 52 of the pad 46 extend through openings 67 and 69 and the associated tab 56 extends through an opening 71. The pads 40 and 42 are connected to the housing 28 identically to the pads 44 and 46. Bosses 41, only one of which is shown in FIG. 10, prevent ears 52 from coming off projections 70. The sections 62, 64 and 66 have studs or projections 68, 70 and 72 received in the holes 54 and 58.

The housing 28 has a top cover 74 sec tired to the housing 28. The top cover has keys 76, a display 78 and a window 106 for infra-red data transmission. The front door 30 has an exit opening 80.

Figure 2:
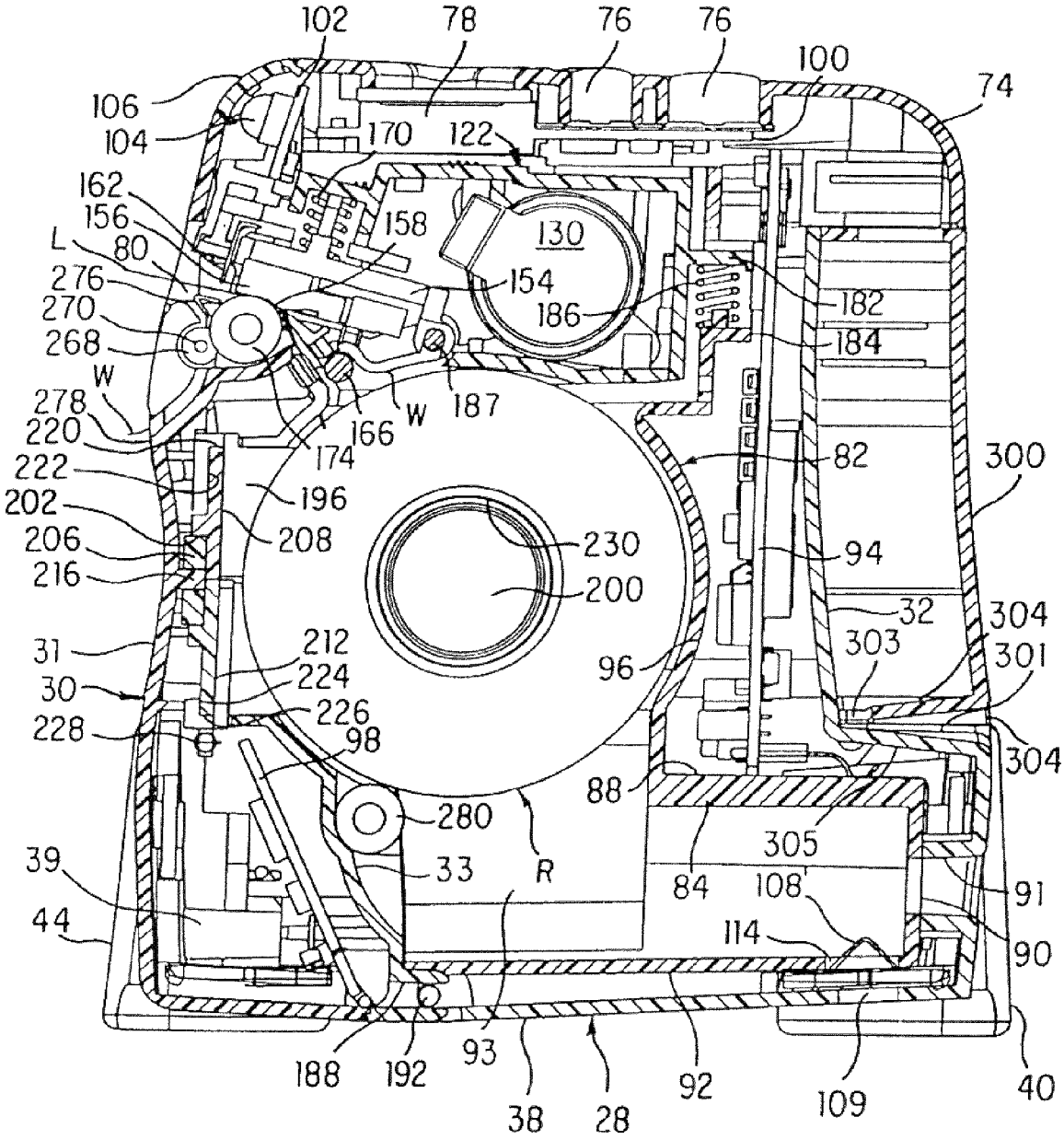
FIG. 2 is a sectional elevational view through the printer.
Figure 4:
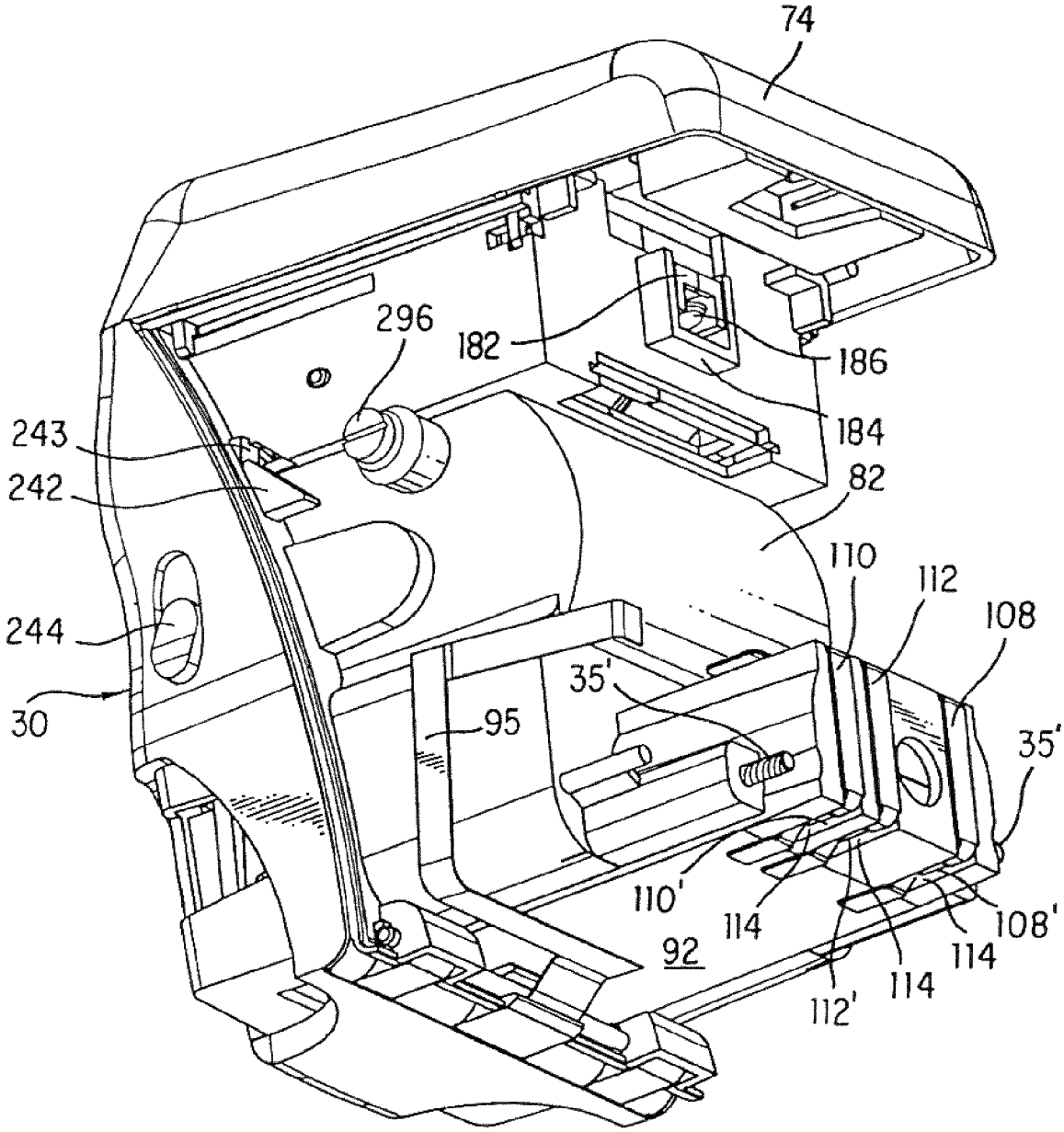
FIG. 4 is a perspective view similar to FIG. 3 but showing both the housing and one of the printed circuit boards removed.
Figure 5:
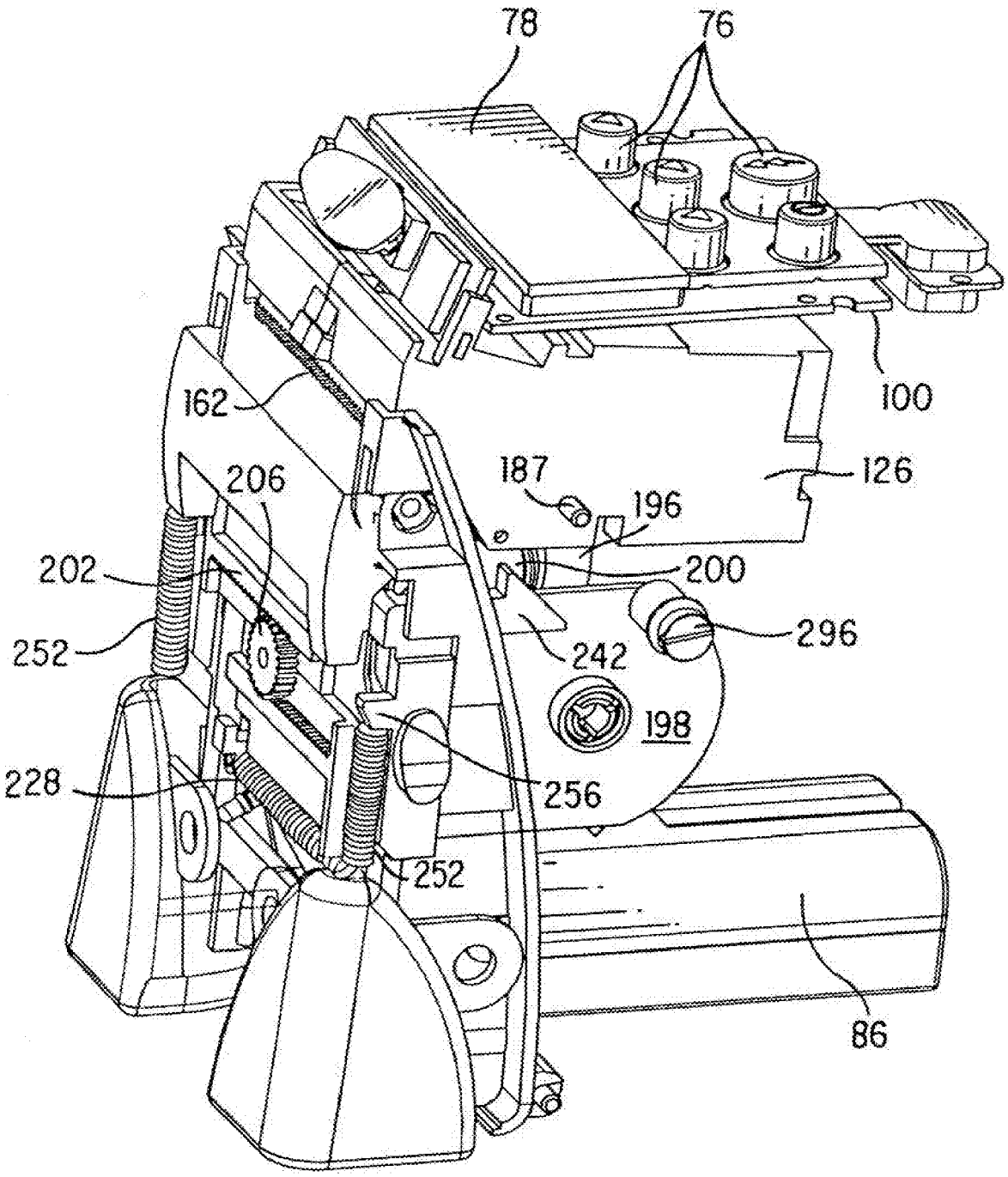
FIG. 5 is a perspective view showing the front and the left side of the printer with certain parts removed.
Figure 6:
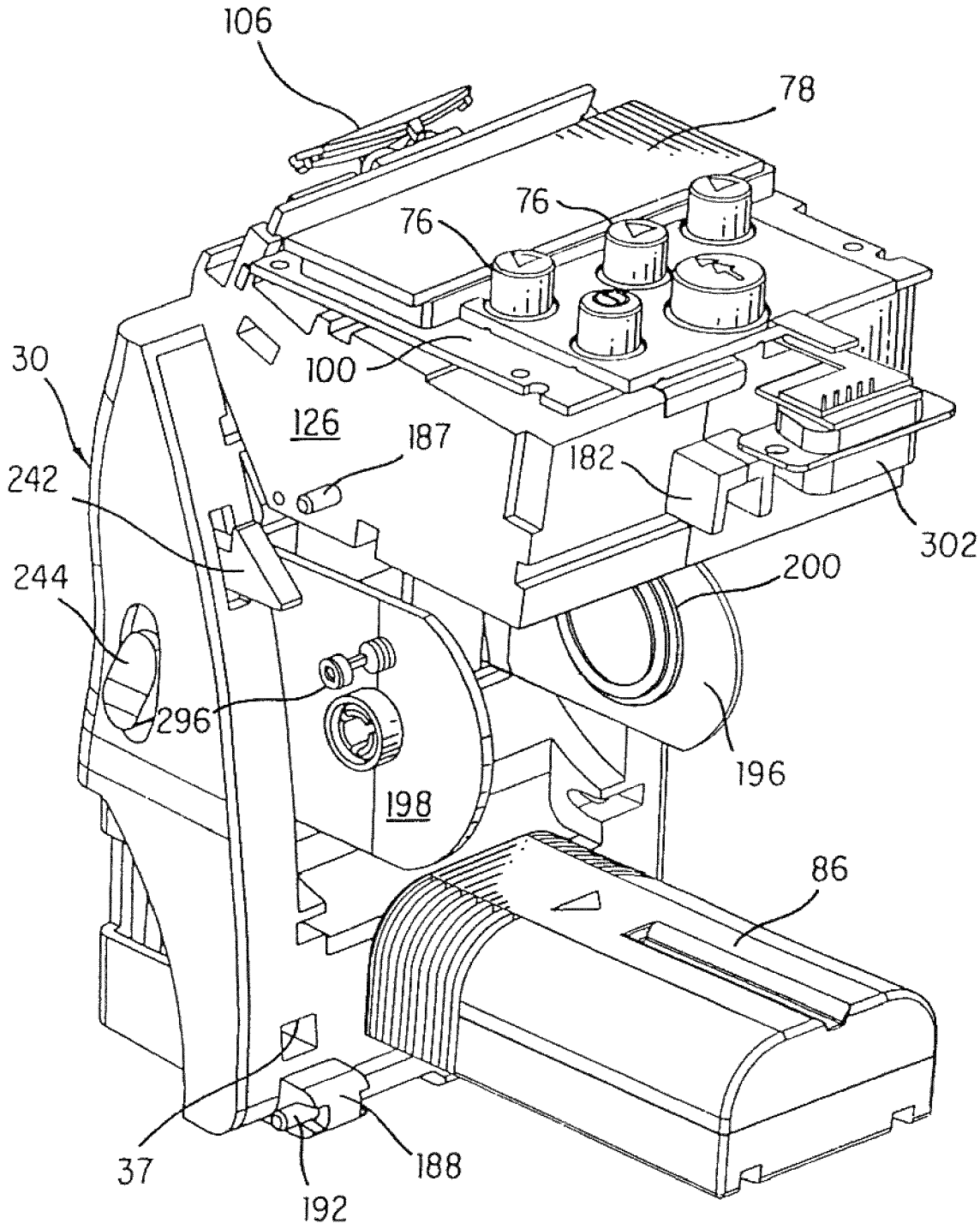
FIG. 6 is a perspective view of the printer with the housing, the upstanding circuit board, the battery compartment and with other parts removed.
Figure 9:
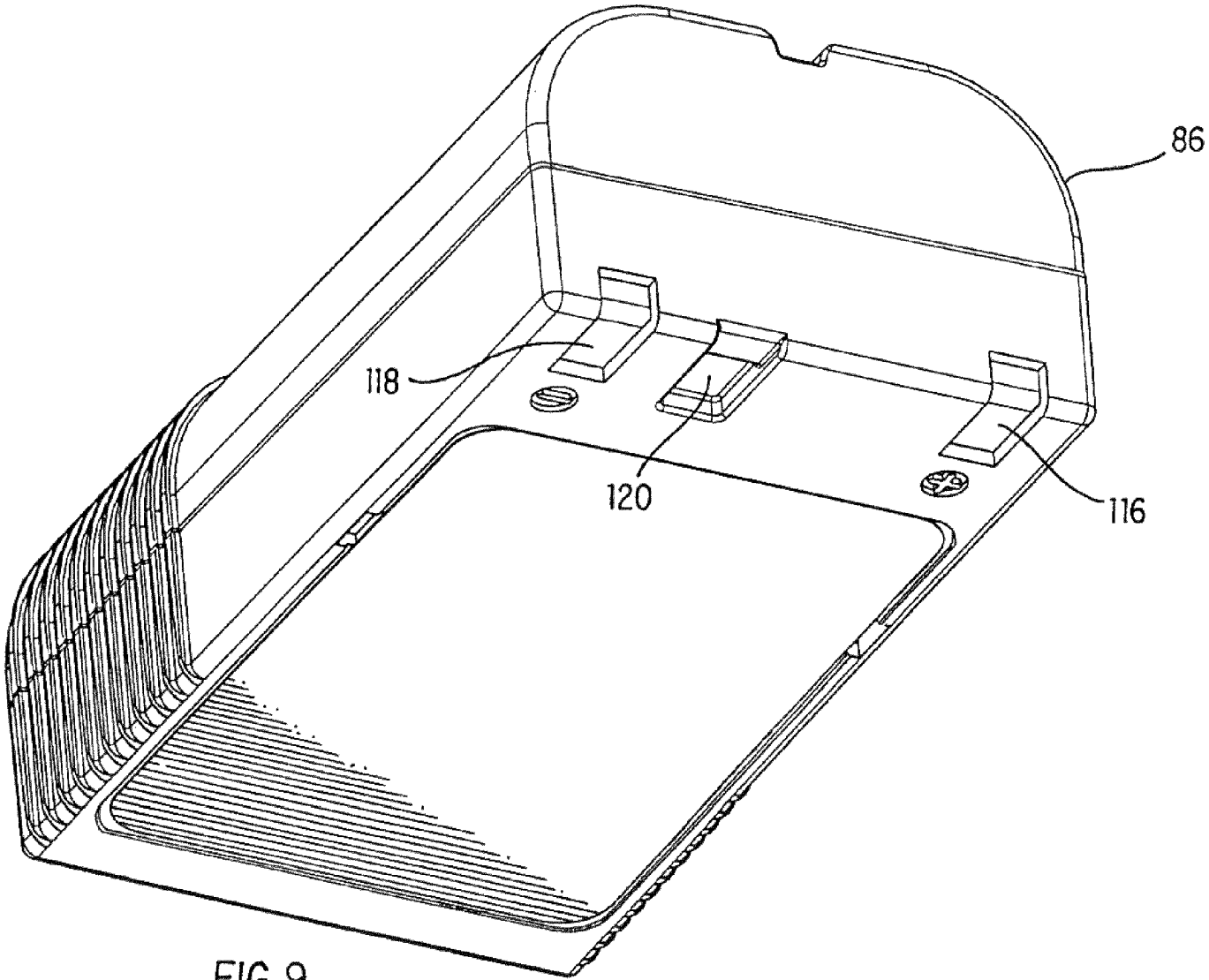
FIG. 9 is a perspective view of the battery used in the printer.

The housing 28 contains a subframe or inner housing generally indicated at 82 (FIG. 2). The subframe 82 is secured to the housing 28 by screws 35' (FIG. 4) received in bosses 39' on the rear wall 32. The subframe 82 has space in a compartment 84 for receiving a battery 86 (FIGS. 5, 6 and 9) for powering the printer 26. The compartment 84 has an upper wall 88, a rear wall 90 and a floor or bottom wall 92. The compartment 84 has an opening 93 into which the battery 86 can be inserted and removed when the door 30 is open. A vertically extending or upstanding printed circuit board 94 is secured in place between the rear wall 32 and a rear wall 96 of the subframe 82. The printed circuit board 94 is electrically connected to the battery 86, to a radio board 98 mounted on the door 30, a printed circuit board 100 for the keys 76 and the display 78, and a printed circuit board 102 for an infra-red receiver. The printed circuit board 102 mount art infra-red sensor 104 aligned with the window 106 on the cover 74. The printed circuit board 98 is connected to the printed circuit board 94 by a flexible connector 95.

Flat, flexible, resilient conductors 108, 110 and 112 having U-shaped configurations and being connected to printed circuit board 94 pass about walls 88, 90 and 92. The conductors 108, 110 and 112 are sandwiched between the wall 90 and a tubular part 91 of the rear wall 32. The conductors 108, 110 and 112 have portions bent into inverted V-shapes which serve as contacts 108', 110' and 112' which extend through three holes 114 (FIG. 2). Alternatively one large hole could be used if desired. The battery 86 (FIG. 9) has contacts 116 and 118 and a recess 120. The contacts 116 and 118 are cooperable with respective contacts 108' and 110'. The contact 112' detents into the recess 120 to releasably hold the battery 86 in position. As shown in FIG. 10, the bottom panel 38 has three spaced holes 109, 111 and 113 aligned with respective contacts 108', 110' and 112'. The holes 109, 111 and 113 enable contacts (not shown) of a battery charger (not shown) to make contact with contacts 108', 110' and 112'. The printer electronics of the printer 26 are disabled when the battery charger contacts contact the contact 112' thereby preventing powering of the printer 26 by means of the battery charger.

Figure 7:
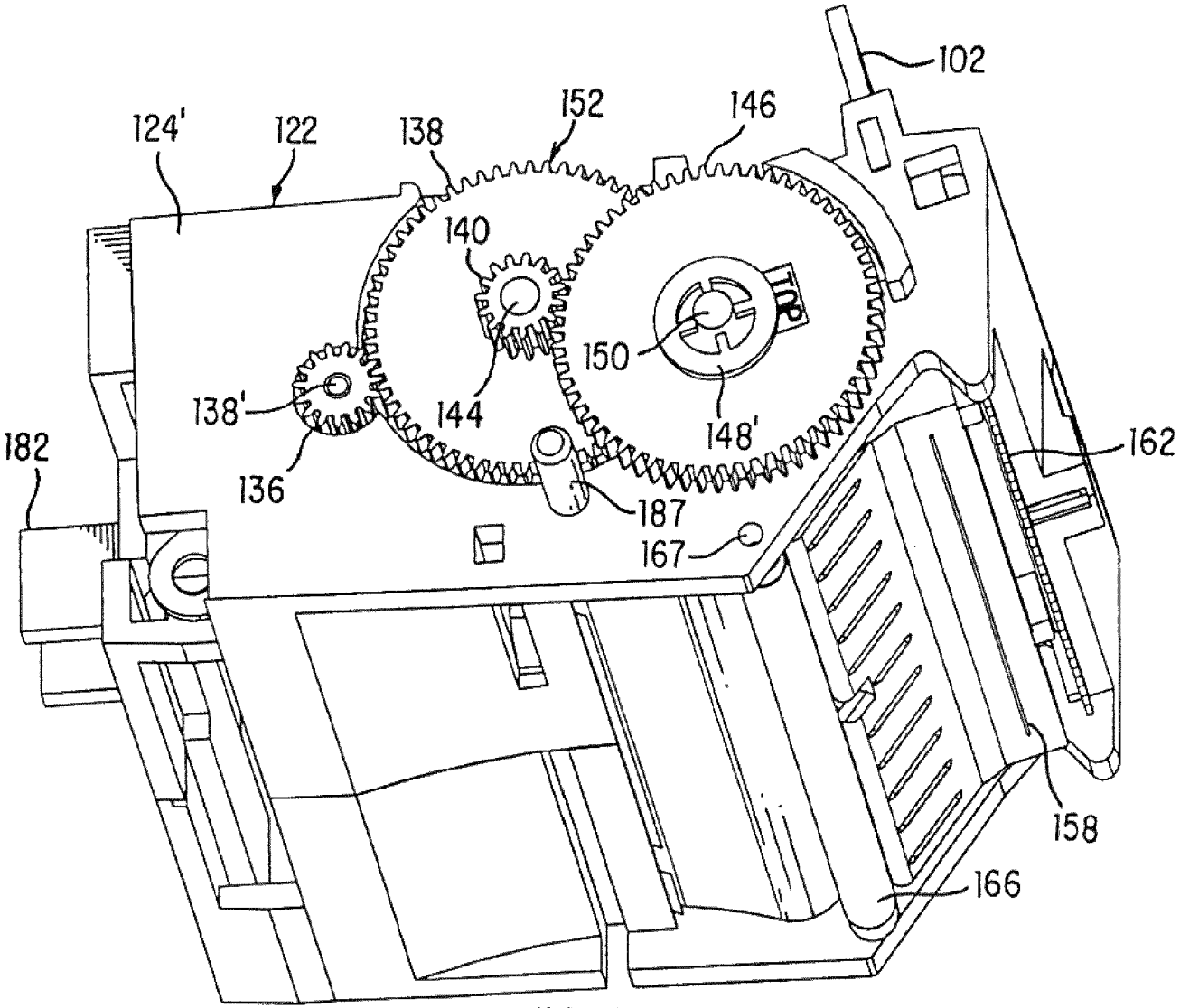
FIG. 7 is a perspective view of the module or subassembly for mounting the motor, gearing, the print head.
Figure 8:
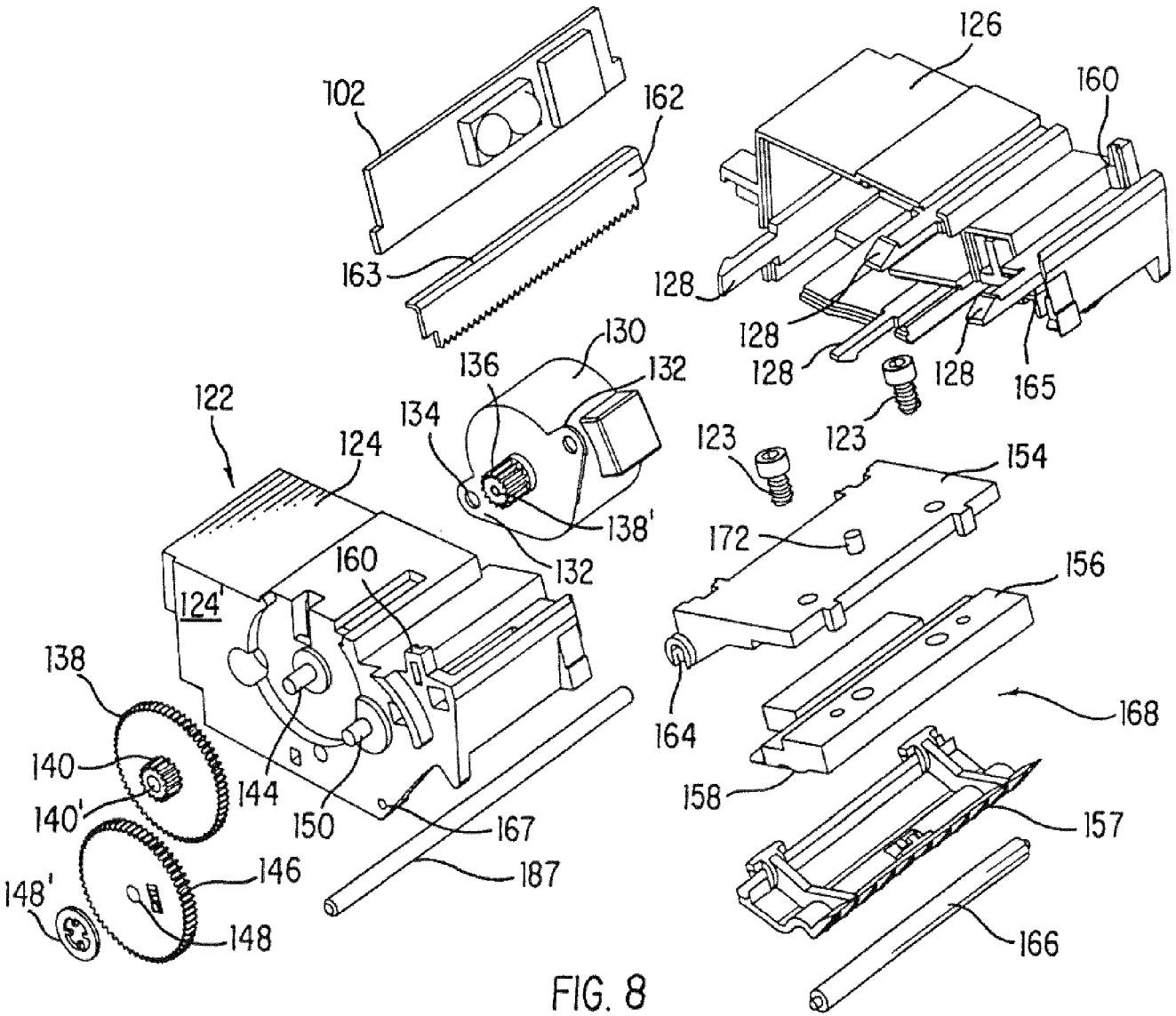
FIG. 8 is an exploded perspective view of the subassembly which is shown assembled in FIG. 7.

With reference to FIGS. 7 and 8, there is shown a subassembly or module generally indicated at 122 which is pivotally mounted in the housing 28. The subassembly 122 is comprised of a mirror image pair of shell-shaped sections 124 and 126 releasably snap-fitted to each other by prongs 128 on the section 126 detected in the section 124. An electric motor 130 has spaced tabs 132 with holes 134. A sleeve on the motor 130 locates the motor 130 in a hole 135' in wall 124'. A gear 136 on motor shaft 138' meshes with a gear 138, and a gear 140 integral with the gear 138 meshes with a gear 146. The gears 136, 138, 140 and 146 comprise gearing generally indicated at 152. The gears 138 and 140 have a common through-hole 140'. A stationary pin 144 on wall 124' of the section 124 is received in the hole 140'. A stationary pin 150 on the wall 124' is received in a hole 148 in the gear 146 and a clip 148' holds the gear 146 on pin 150. Secured to the front underside of the subassembly 122 by a pin or rod 187 is a mounting plate 154. A heat sink 156 is secured to the underside of the plate 154 by screws 123. A thermal print head 158 is secured to the underside of the heat sink 156. Ends of the printed circuit board 102 are secured in recesses 160 in the sections 124 and 126. A tear edge 162 has a flange 163 supported on a shelf 165.

Figure 12:
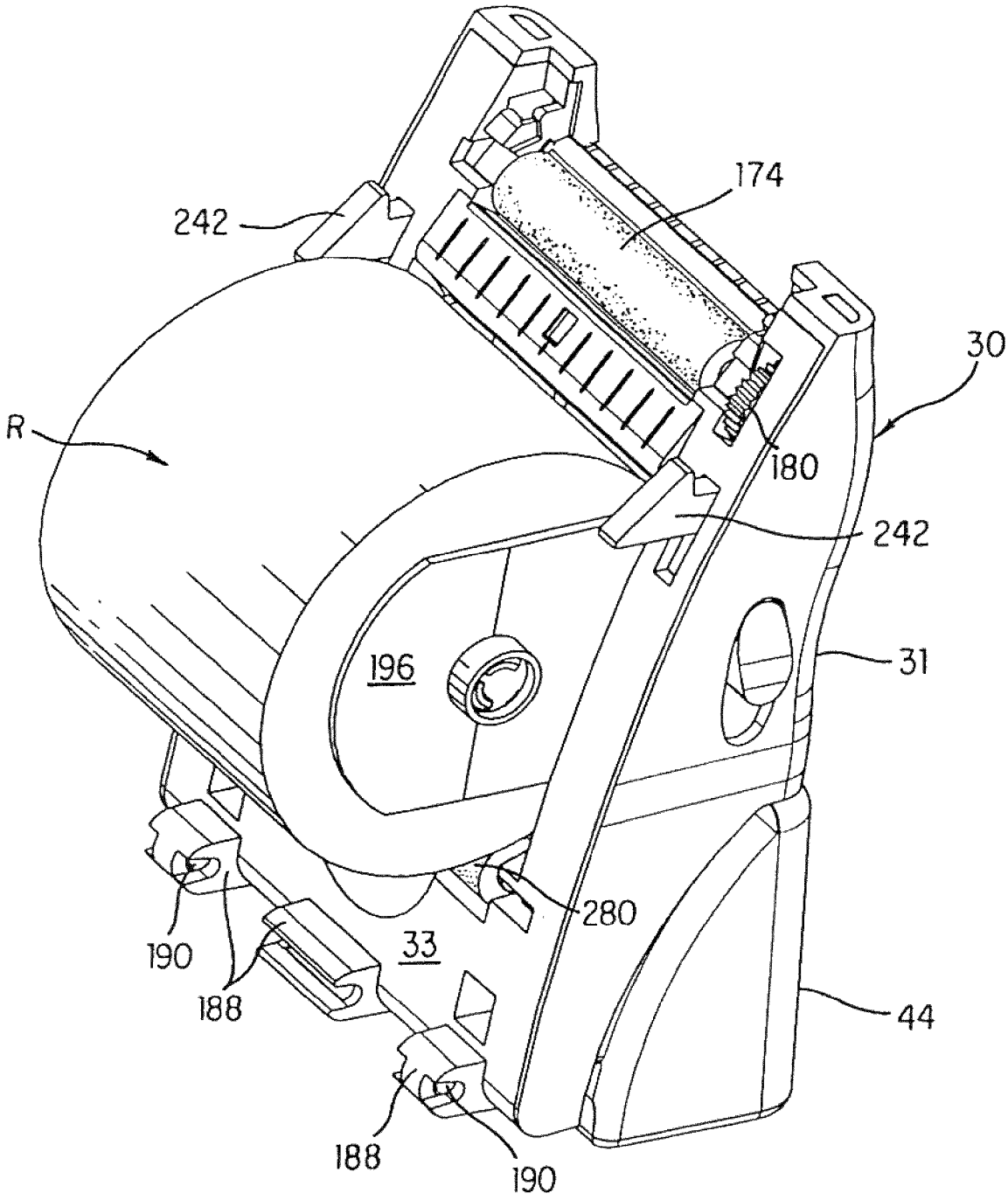
FIG. 12 is a perspective view of the door, a supply roll mounted on the door, the platen roll and gear, and part of the latch.
Figure 13:
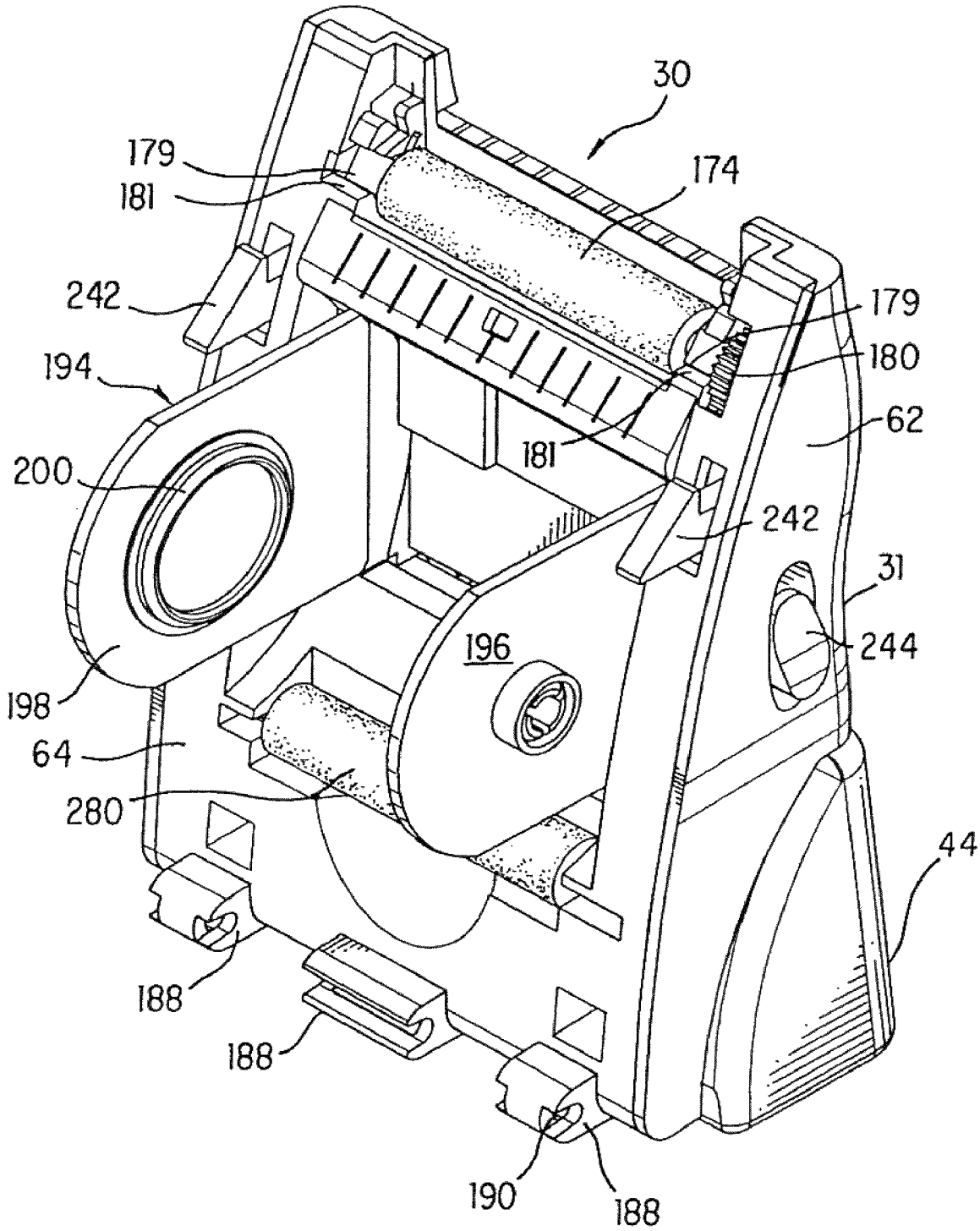
FIG. 13 is a perspective view similar to FIG. 12, but showing the supply roll removed.
Figure 14:
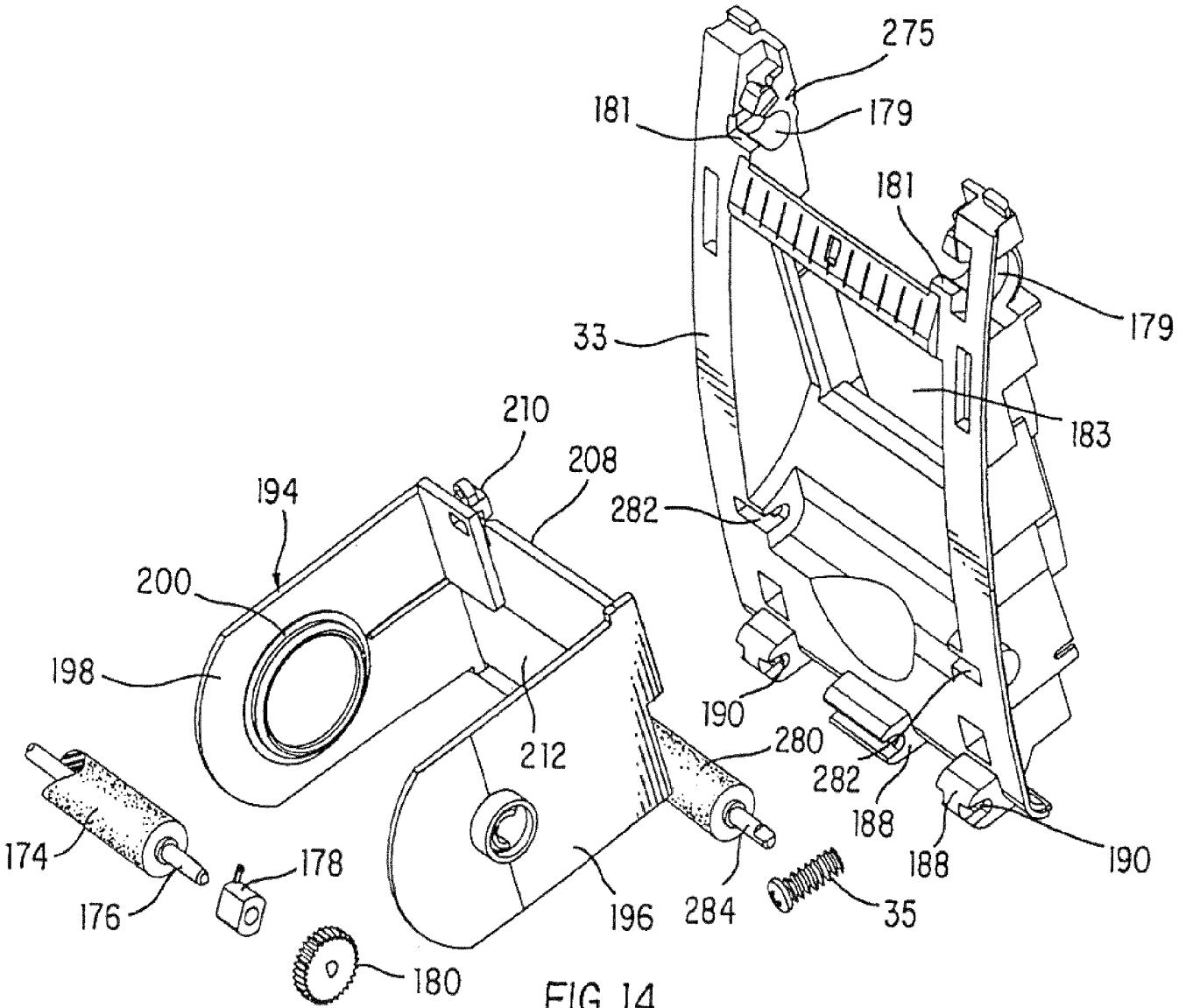
FIG. 14 is an exploded perspective view of the supply roll holder and the inner portion of the door.

The plate 154 has an inverted U-shaped opening 164 for receiving a rod 187. A rod 166 is mounted in axially spaced holes 167 in the sections 124 and 126. A print head assembly generally indicated at 168 includes the plate 154, the heat sink 156, the print head 158 and a guide 157 pivotally mounted on the rod 187. A compression spring 170 (FIG. 2) acts on inner surfaces of the sections 124 and 126 and the plate 154. The plate 154 has a pin 172 which helps retain the spring 170 in position. The spring 170 urges the print head 158 into printing cooperation with an operative platen roll 174. The platen roll 174 (FIG. 12) has a shaft 176 mounted in identical bearing blocks 178 (FIG. 14). A gear 180 secured to the shaft 176 meshes with the gear 146 when the door 30 is closed. Thus, the motor 130 drives the gearing 152 which in turn drives the gear 180 and the platen roll 174.

The subassembly 122 has an inverted U-shaped pocket 182 (FIGS. 2 and 7) opposed to a U-shaped pocket 184. The pockets 182 and 184 mount a compression spring 186. The subassembly 122 is pivotally mounted on the rod or pivot 187 and is urged by the spring 186 toward a counterclockwise position (FIG. 2). The pivot 187 is mounted in opposed side walls of the subframe 82 as indicated at 37. Accordingly, the print head 158 is urged toward the platen roll 174 by the spring 186.

Figure 20:
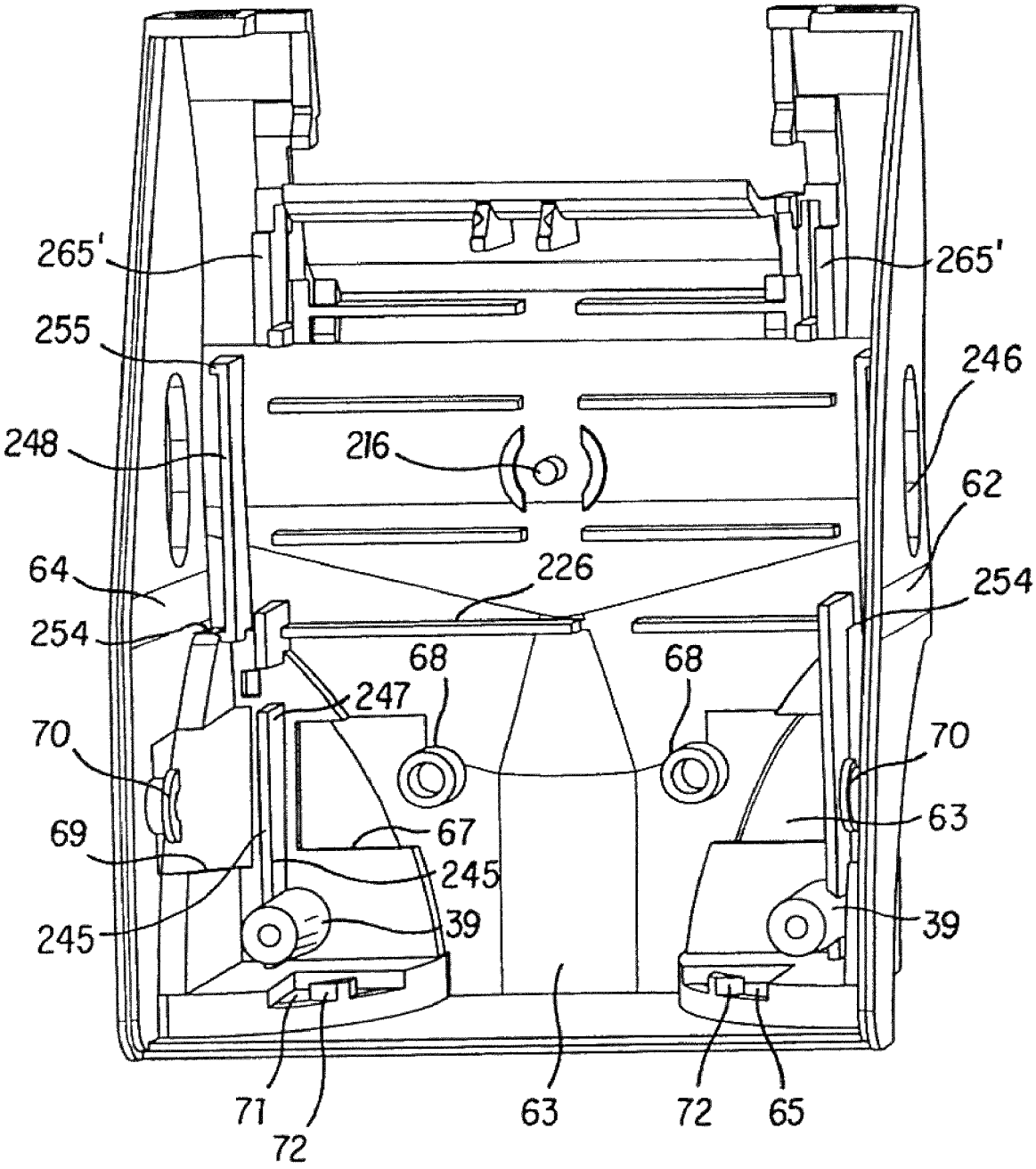
FIG. 20 is a perspective view of inside of the outer door panel.

The inner panel 33 of the door 30 has bosses 188 (FIG. 14) with aligned holes 190 for receiving a shaft or pivot 192 (FIG. 2) which pivotally mounts the door 30 for movement between closed and open positions. The inner panel 33 mounts a label roll holder generally indicated at 194 in opening 183. The holder 194 includes a pair of identical holder members 196 and 198 each having a rotatably mounted hub 200. The holder members 196 and 198 are each movable in unison toward and away from each other to enable supply roll of different widths to be held by the holder 194. There is a laterally extending rack 202 on the holder member 196 and a laterally extending rack 204 on the holder member 198. The racks 202 and 204 mesh with a pinion 206. The rack 202 is integral with a lateral section 208 guided by a guide 210 when the lateral section 208 moves to the right (FIG. 10). The rack 204 is integral with a lateral section 212. The lateral section 212 is guided by a guide 214 when the section 212 moves to the left (FIG. 10). The upper surface 212' of the section 212 is guided by the lower surface 208' of the section 208. The pinion 206 is rotatably mounted on a fixed pin 216 (FIGS. 2 and 20). The upper surface of the section 208 is guided by surfaces 220 and 222 (FIG. 2). The section 212 is guided by surfaces 224 and 226. A tension spring 228 is secured at one end to the guide 214 and at its other in a hole in the outer panel 31. Thus, when no supply roll R is mounted on the hubs 200, the spring 228 urges the holder members 196 and 198 toward each other until the ends of sections 208 and 212 contact ribs. In order to insert a supply roll R onto the hubs 200, the holder members 196 and 198 are manually spread apart until the hubs 200 can enter the central hole 230 in the roll R.

Figure 15:
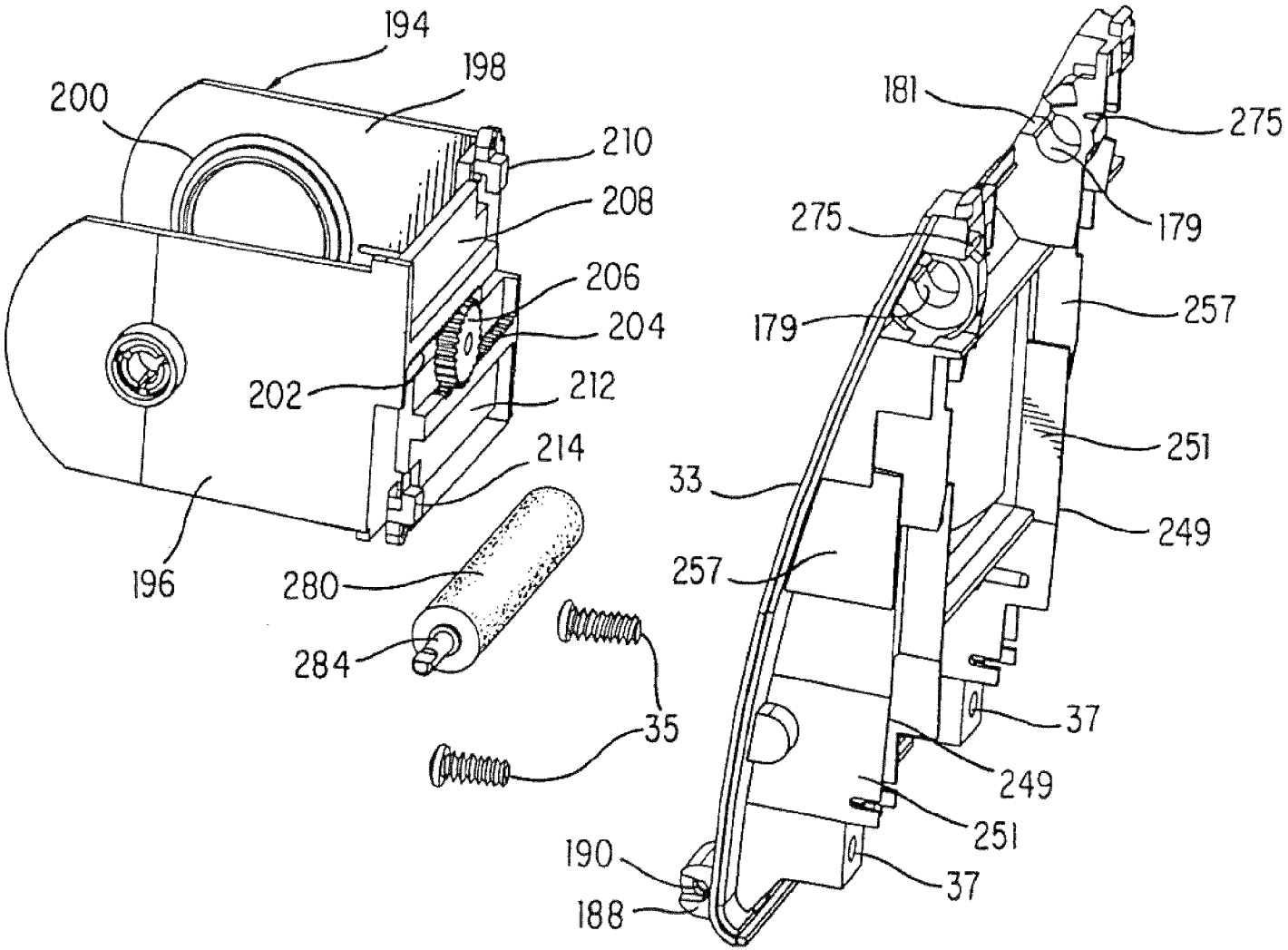
FIG. 15 is an exploded perspective view of the supply roll holder and the inner door panel shown in FIG. 14.

The outer panel 31 slid ably mounts a U-shaped one-piece slide generally indicated at 240. The slide 240 includes a pair of latches 242. Latches 242 latch with members 243 on opposite sides of the subframe 82 to hold the door 30 closed. The slide carrier 240 has a pair of finger-engageable buttons 244 received with clearance in slots 246 in the side portions 62 and 64. The slide 240 is guided by guides 257 received in slots 258 in the slide 240. Rear surfaces 241 of legs 240' are guided by end edges 245 of ribs 247 (FIG. 20). End edges 249 (FIG. 15) of ribs 251 guide front faces 253 of the legs 240' of the slide 240. Accordingly, the slide 240 is guided for vertical movement by and between the inner door panel 33 and the outer door panel 31. The slide 240 is urged upwardly by a pair of parallel compression springs 252 acting on surfaces 254 on the door panel 33 and on lugs 256 on the slide 240. The springs 252 are received in spaces between ribs 248 and respective side portions 62 and 64. The ribs 248 have integral stops 255 for the lugs 256.

Figure 17:
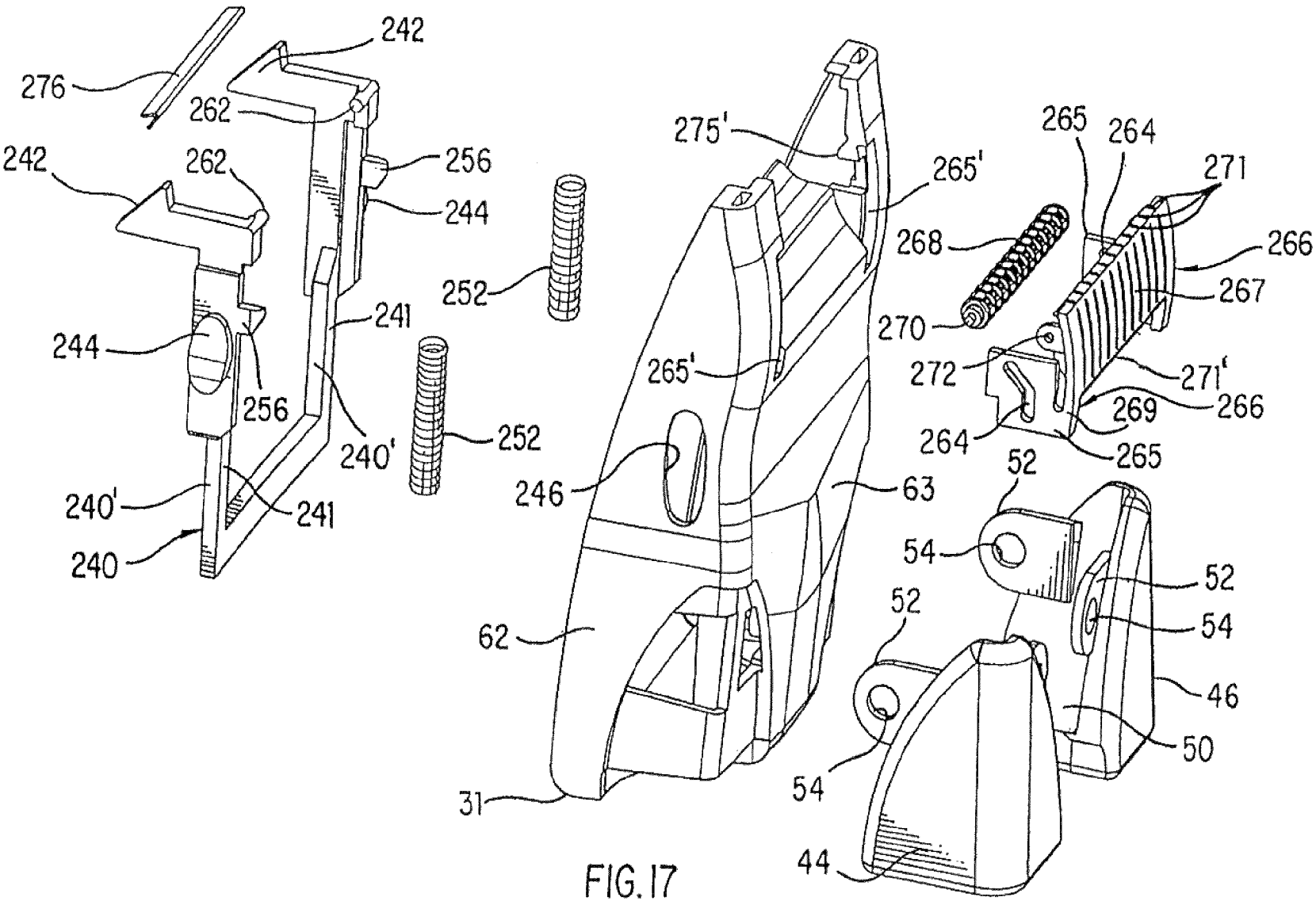
FIG. 17 is an exploded perspective view of the components shown in FIG. 16.
Figure 18:
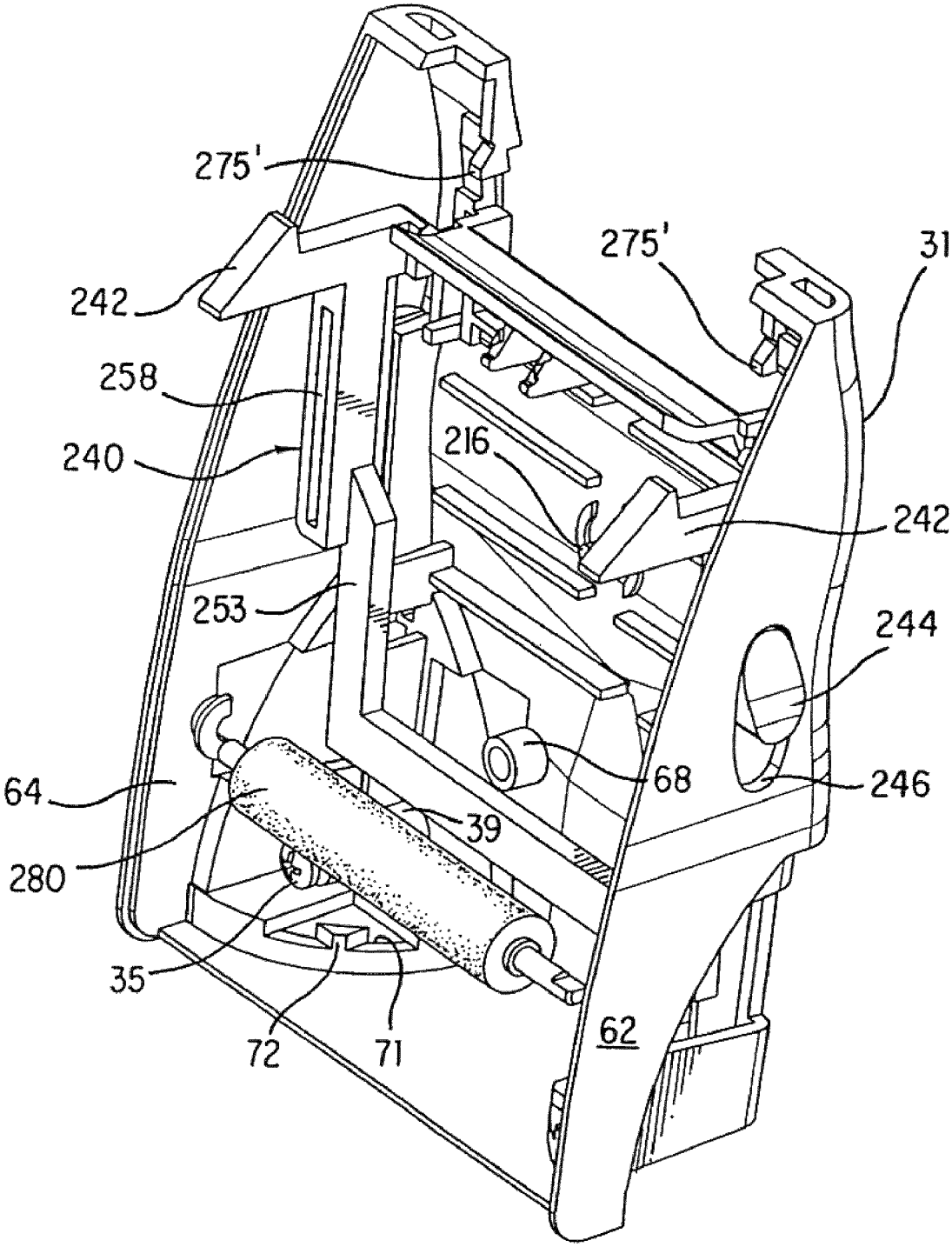
FIGS. 18 and 19 are perspective views showing the latch assembled onto the outer door panel.

The slide 240 has a pair of opposed pins 262 (FIG. 17) received in contoured slots 264 in horizontally slidable slide blocks 265 of a carrier 266. The slide blocks 265 are slidable in slots 265'. A pressure roll 268 has a shaft 270 the end portions of which are received in holes 272 and 274 in tabs 273 on a cantilevered section or leaf spring 267 of the carrier 266. The leaf spring 267 is flexed to resiliently urge the pressure roll 268 against the platen roll 174 to assure that the platen roll 174 advances the web W. The section 267 is cantilevered to the slide blocks 265 as indicated at 269. The top surface of the section 267 has spaced label-supporting ridges which support a delaminated label L as shown in FIG. 2. The lower edge of the section 267 has a serrated tear edge 271' for severing the spent carrier web W. As the slide 240 is moved downwardly against the action of the springs 252, the carrier 266 is camped out of contact with the platen roll 174 to a position spaced from the platen roll 174.

The roll R can be a linered supply web such as a web W with labels L releasably adhered thereto by pressure sensitive adhesive as shown in FIG. 2. As the platen roll 174 rotates, the carrier web W (FIG. 2) is drawn about a delaminator 276. The delaminator 276 is a bent metal plate in the shape of an acute angle or a "V" received on a V-shaped ledge 275 on the inner door panel 33. Abutments 275' on the outer door panel 31 hold the delaminator 276 in place. Alternatively, the delaminator can be a peel roller (not shown). After passing about the delaminator 276, the spent carrier web W passes between the platen roll 174 and the pressure roll 268 and exits the printer 26 through an opening 278. In the event the roll R is composed of linerless adhesive-backed label material or tag material, such a web passes between the print head 158 and the platen roll 174 and simply exits through the opening 80. In the case of linerless adhesive-backed label material, the adhesive side or underside of the label material web W contacts the platen roll 174 and thus the surface of the platen roll 174 is provided with a non-stick surface such a commonly-used siliconized coating on the platen roll or the platen roll itself can be comprised of silicone rubber which does not adhere well to the adhesive.

Figure 19:
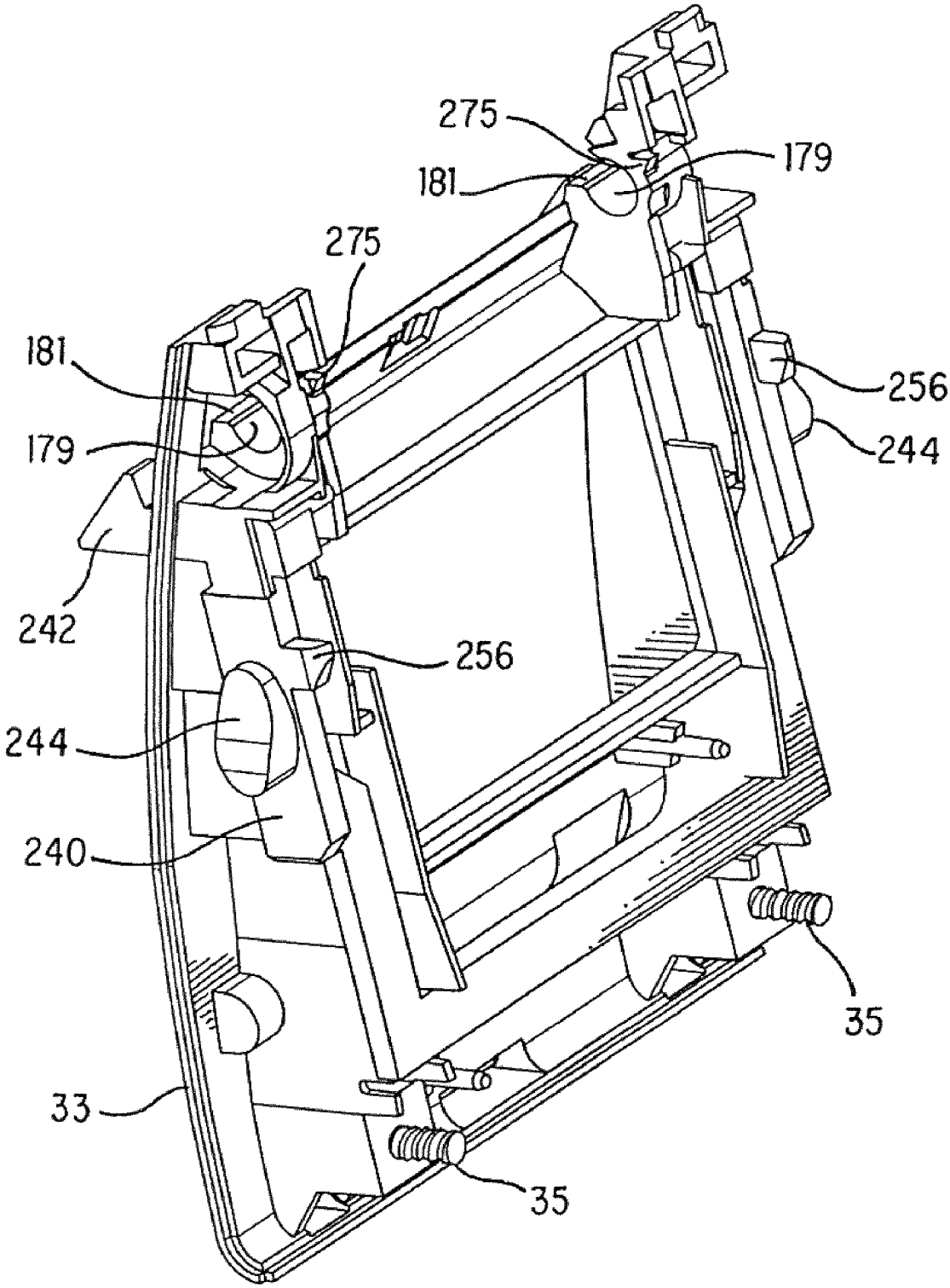

The door 30 can pivot about 100° between its latched position and an open position. The space within the subframe or inner housing 82 can receive the roll R. When the door 30 is open, a battery 86 can be easily inserted into or removed from the compartment 84 through opening 94 (FIG. 2). A roll R of labels L or tags can be easily inserted onto the holder 194, and the print head 158 can be easily cleaned. As shown in FIGS. 2, 6, 12 through 15 and 18, the printer 26 is provided with C-shaped snap sockets 282 for receiving end portions of a shaft 284 of a spare platen roll 280. In the event the operative platen roll 174 needs to be changed, the platen roll 174 can be removed and bearing blocks 178 and the gear 180 from the platen roll 174 can be applied to the shaft 284. The roll 280 with the bearing blocks 178 and the gear 180 thereon can be repositioned into the operative portion formerly occupied by the platen roll 174 and the bearing blocks 178. As shown for example in FIG. 19, the inner door panel 33 has aligned C-shaped pockets 179 for receiving the bearing blocks 178. By rotating the bearing blocks 178, the bearing blocks 178 can be inserted into or removed from the pockets 179 through narrow openings 181. In the event linerless adhesive-backed label material is to be used, the platen 280 can likewise have a non-stick or silicone coating such as silicone or it can be comprised of siliconized rubber.

Figure 3:
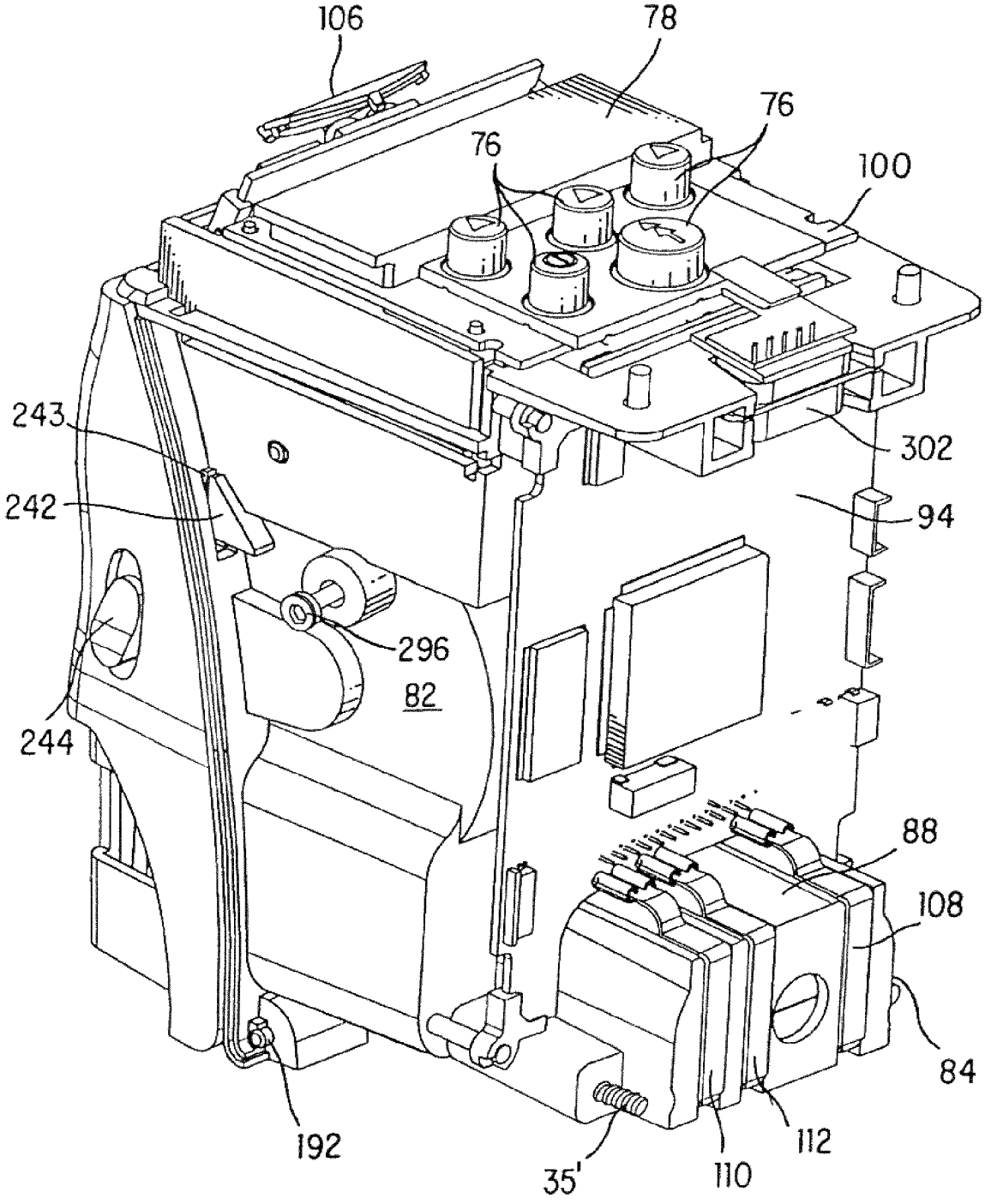
FIG. 3 is a perspective view of the printer with the housing removed.

A cup-shaped cover 300 is snap-fitted into a hollow pocket 301 in the rear wall 32 of the housing 28. A cable (not shown) is plugged into a connector 302 (FIG. 3) and the cable passes inside the cover 300 and exits the printer via a hole 303 and a port 304. Bottom wall 304 of the cover can flex and resiliently hold the cable between the bottom wall 304 and the bottom 305 of the pocket 301.

Figure 21:
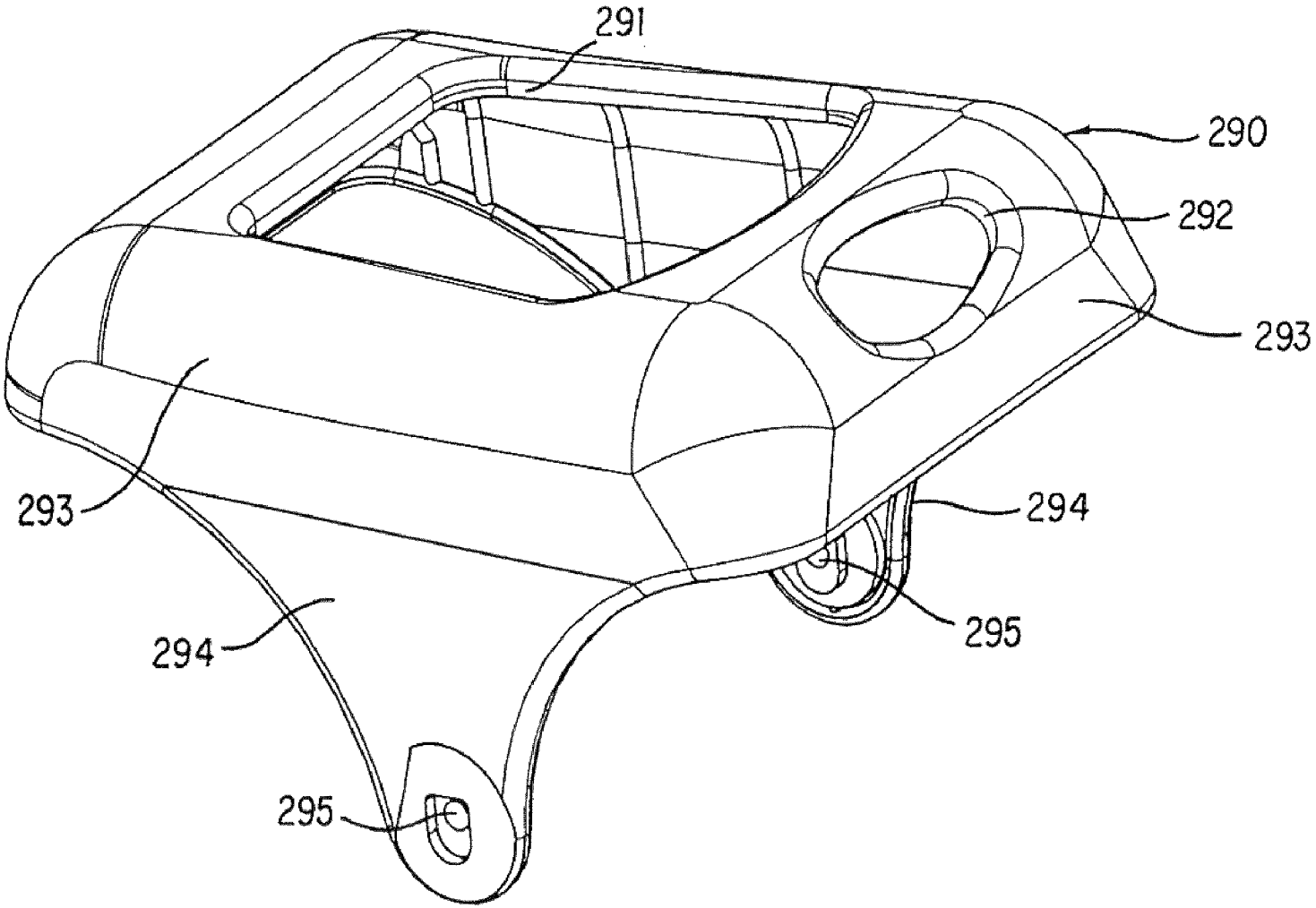
FIG. 21 is a perspective view of a resilient elastomeric protector pad for the upper portion of the printer.
Figure 22:
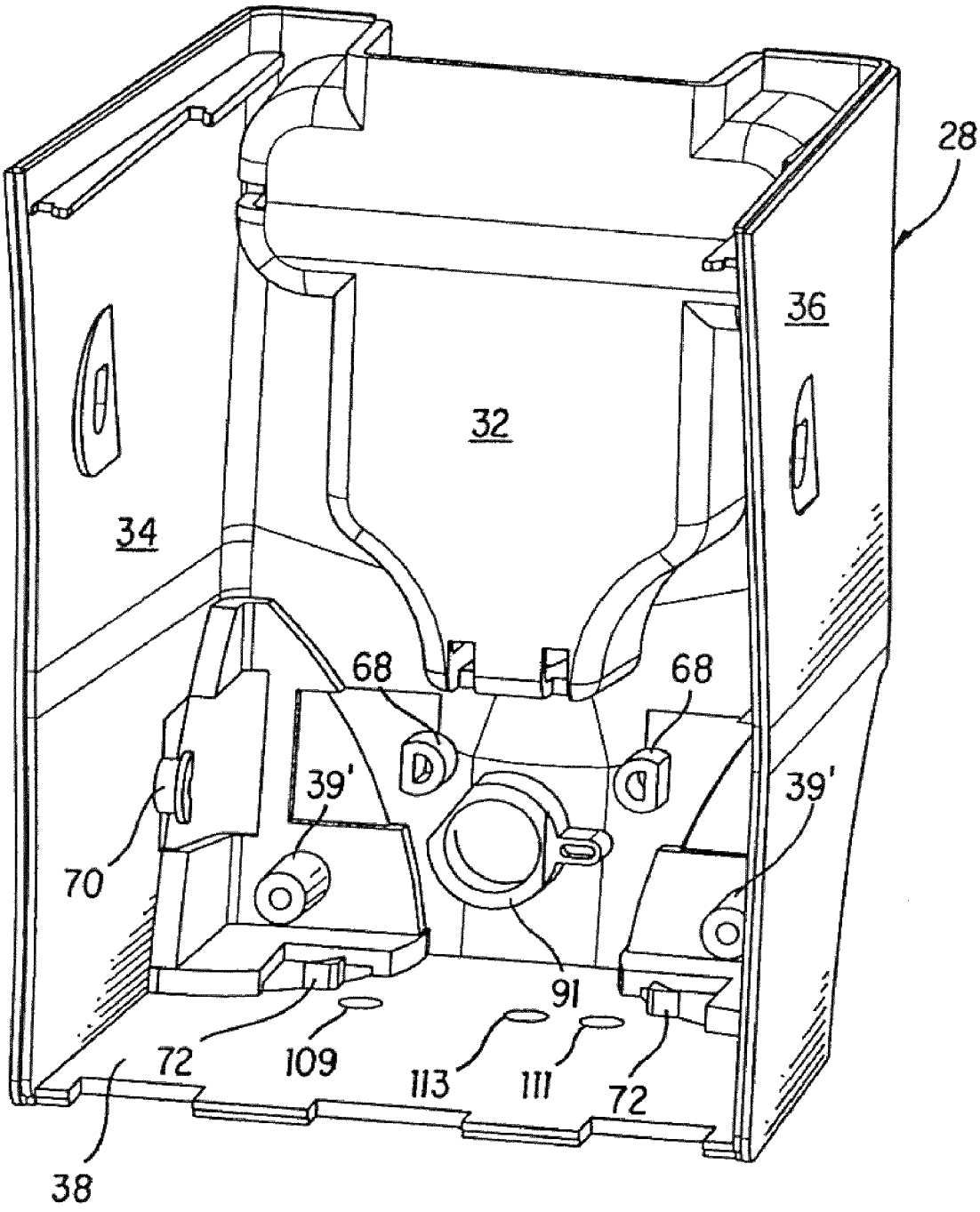
FIG. 22 is a perspective view showing the inside of the housing.

With reference to FIG. 21, a protector pad 290 is shown to cover the entire top portion 74 of the printer with the exception of access openings 291 and 292. The pad 290 is also shown in FIG. 1 but is omitted from the other figures for the sake of clarity. The pad 290 is generally rectangular but has a continuous depending shoulder 293. The long sides of the pad 290 has depending flaps 294 with holes 295 for receiving posts 296. The posts 296 can also serve as anchors for a carrying strap (not shown) by which the printer 26 may be worn or carried at the user's waist.

Except for the springs 170, 182, 228 and 252, various fasteners, the motor 130, the battery 86, various electrical conductors, the tear bar 162, various printed circuit board components, rods 166 and 187, and shafts 176 and 270, the printer is constructed of molded plastics material and the platen rolls 174 and 280 are composed of elastomeric material.

Other embodiments and modifications of the invention will suggest themselves to those skilled in the art, and all such of these as come within the spirit of this invention are included within its scope as best defined by the appended claims.

The invention claimed is:

1. A printer, comprising:

an upstanding housing having a supply-roll-receiving space capable of receiving a supply roll of a composite web having pressure sensitive labels releasably adhered to a carrier web, the housing having web paths for the carrier web, a platen roll on the housing, a print head cooperable with the platen roll and capable of printing on the pressure sensitive labels, the housing having a front door movable between an open position and a closed operative position in which the supply roll can be received in the supply-roll-receiving space, a delaminator on the front door downstream of the print head and capable of delaminating printed labels from the carrier web, a first tear edge on the housing above a level of the delaminator and capable of tearing off a printed composite web or the carrier web, a pressure roll cooperable with the platen roll downstream of the delaminator, a second tear edge capable of tearing off the carrier web, the second tear edge being mounted on the door downstream of the pressure roll, a holder on the front door capable of holding the supply roll, the supply roll being capable of being mounted on the holder when the door is in the open position, and the holder including a pair of holder members movable in unison toward and away from each other to accommodate supply rolls of different widths.

2. A printer as defined in claim 1, including an electric motor disposed above the level of the supply-roll-receiving space, and a battery-receiving space below the level of the holder.

3. A printer as defined in claim 2, wherein the battery-receiving space includes three sides with U-shaped conductors about the three sides to make contact with terminals of a battery and releasably detent the battery in the battery-receiving space.

4. A printer as defined in claim 1, including circuit-board-receiving space, and wherein the supply-roll-receiving space is between the front door and the circuit-board-receiving space.

5. A printer as defined in claim 4, wherein a circuit board is positioned in the circuit board receiving space and the circuit board is connected to a battery positioned in the battery-receiving space and a radio board.

6. A printer as defined in claim 1, including an electric motor disposed above the level of the supply roll receiving space, a battery-receiving space below the level of the holder, a circuit board receiving space, and wherein the supply-roll-receiving space is between the front door and the circuit-board-receiving space.

7. A printer as defined in claim 1, wherein the housing includes a subframe secured to the housing, the subframe includes the battery-receiving space.

8. A printer as defined in claim 7, including a U-shaped slide having a pair of latches to latch with the subframe to hold the front door in a closed position.

9. A printer as defined in claim 8, wherein the front door has an outer door panel and an inner door panel secured to the front door.

10. A printer as defined in claim 1, wherein the housing includes a subassembly pivotally mounted in the housing and the subassembly includes an electric motor.

11. A printer as defined in claim 1, including a spring for urging the print head into printing cooperation with the platen roll.

12. A printer as defined in claim 1, wherein the delaminator is one of a bent metal plate having an acute angle or a peel roller.

13. A printer as defined in claim 1, wherein the housing further includes a top cover and the top cover has keys, a display and a window for infrared data transmission.

14. A printer as defined in claim 13, wherein the top cover has a protector pad covering the top cover except for areas of the keys, display and window.

* * * * *